US009352566B2

(12) United States Patent
Hayashi

(10) Patent No.: US 9,352,566 B2
(45) Date of Patent: May 31, 2016

(54) LIQUID EJECTION DEVICE

(71) Applicant: BROTHER KOGYO KABUSHIKI KAISHA, Nagoya-shi, Aichi (JP)

(72) Inventor: Hideki Hayashi, Nagoya (JP)

(73) Assignee: BROTHER KOGYO KABUSHIKI KAISHA, Nagoya-Shi, Aichi (JP)

( * ) Notice: Subject to any disclaimer, the term of this patent is extended or adjusted under 35 U.S.C. 154(b) by 0 days.

(21) Appl. No.: 14/496,392

(22) Filed: Sep. 25, 2014

(65) Prior Publication Data

US 2015/0091991 A1 Apr. 2, 2015

(30) Foreign Application Priority Data

Sep. 27, 2013 (JP) ..... 2013-201418
Sep. 18, 2014 (JP) ..... 2014-189706

(51) Int. Cl.

| | |
|---|---|
| ***B41J 2/19*** | (2006.01) |
| ***B41J 2/14*** | (2006.01) |
| *B41J 2/175* | (2006.01) |
| *B41J 2/21* | (2006.01) |

(52) U.S. Cl.

CPC ..... *B41J 2/14233* (2013.01); *B41J 2/175* (2013.01); *B41J 2/17509* (2013.01); *B41J 2/17503* (2013.01); *B41J 2/17513* (2013.01); *B41J 2/21* (2013.01); *B41J 2002/14266* (2013.01); *B41J 2002/14419* (2013.01); *B41J 2002/14459* (2013.01)

(58) Field of Classification Search

None

See application file for complete search history.

(56) References Cited

U.S. PATENT DOCUMENTS

| | | | | |
|---|---|---|---|---|
| 5,087,930 | A * | 2/1992 | Roy | B41J 2/155 347/22 |
| 2006/0244797 | A1 | 11/2006 | Tajima | |
| 2009/0189951 | A1 | 7/2009 | Tajima | |

FOREIGN PATENT DOCUMENTS

| | | |
|---|---|---|
| JP | 2006/327176 | 12/2006 |
| JP | 2007/245445 | 9/2007 |
| JP | 2010/017926 | 1/2010 |
| JP | 4985639 | 7/2012 |

* cited by examiner

*Primary Examiner* — Lisa M Solomon

(74) *Attorney, Agent, or Firm* — Frommer Lawrence & Haug LLP

(57) ABSTRACT

An ink ejection device comprises: an ink supply section including a plurality of ink chambers respectively containing the plural kinds of inks; and a head section having plural groups of nozzles and ejecting the plural kinds of inks to be supplied from the ink supply section. The head section includes a plurality of supply ports which are aligned in the scanning direction and through which the plural kinds of inks are supplied. The ink supply section includes: a plurality of connection passages respectively connecting the plurality of supply ports to the ink chambers containing the inks to be supplied respectively to the supply ports; and a plurality of air discharge passages connected respectively to the plurality of ink chambers. Then, the plurality of ink chambers are aligned in the conveying direction.

24 Claims, 15 Drawing Sheets

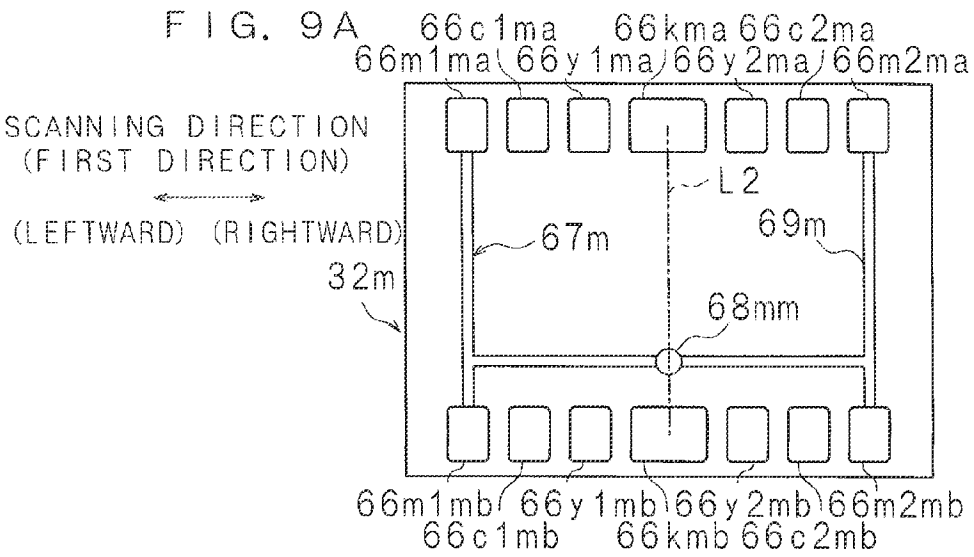
FIG. 9A
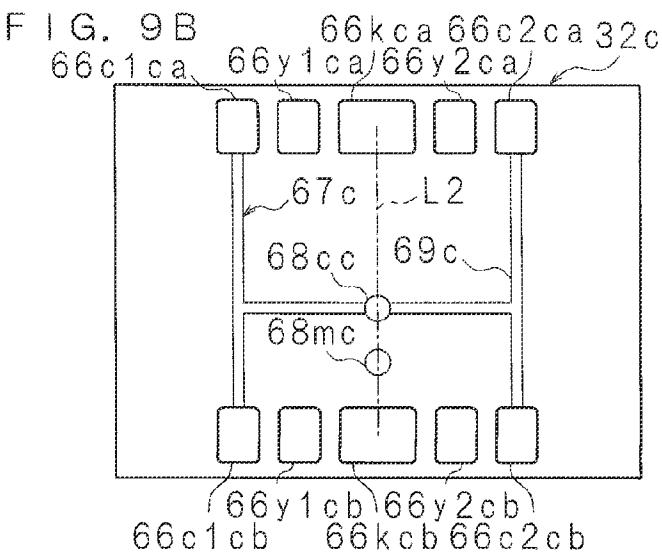
FIG. 9B
FIG. 9C
FIG. 9D

LIQUID EJECTION DEVICE

CROSS-REFERENCE TO RELATED APPLICATIONS

This non-provisional application claims priority under 35 U.S.C. §119(a) on Patent Application No. 2013-201418 filed in Japan on Sep. 27, 2013 and Patent Application No. 2014-189706 filed in Japan on Sep. 18, 2014, the entire contents of which are hereby incorporated by reference.

TECHNICAL FIELD

The present invention relates to a liquid ejection device.

BACKGROUND

Japanese Patent No. 4985639 discloses an ink jet printer as an example of a liquid ejection device. The printer includes: an ink jet head (a liquid ejection section) ejecting ink; and a buffer tank (a liquid supply section) arranged above the ink jet head and supplying the ink to the ink jet head. The ink jet head and the buffer tank are mounted on a carriage moving in the scanning direction and hence move in the scanning direction together with the carriage.

The ink jet head includes four ink introduction ports (supply ports) through which inks of four colors (black, magenta, yellow, and cyan) are supplied respectively. Here, one ink introduction port is provided for black ink and one ink introduction port is provided for magenta ink. However, two ink introduction ports are provided for yellow ink and two ink introduction ports are provided for cyan ink. That is, the ink jet head includes a total of six ink introduction ports. Then, the six ink introduction ports are aligned in the scanning direction of the ink jet head.

The buffer tank is connected to four ink tanks through tubes. Then, the inks of four colors are supplied from the four ink tanks to the buffer tank. The buffer tank includes six air-liquid separation chambers respectively corresponding to the six ink introduction ports of the ink jet head. Here, two air-liquid separation chambers are provided for yellow ink and two air-liquid separation chambers are provided for cyan ink similarly to the ink introduction ports. Then, each two air-liquid separation chambers into which ink of the same color is introduced are in communication with each other. Further, the six air-liquid separation chambers are aligned in the scanning direction of the ink jet head in correspondence to the six ink introduction ports. The ink supplied from each ink tank to the buffer tank flows into the air-liquid separation chamber. Here, in a case that air is mixed in the supplied ink, when the ink flows from the air-liquid separation chamber toward the ink introduction port of the ink jet head located thereunder, the air mixed in the ink is separated from the ink and then collected in the upper portion of the air-liquid separation chamber. Thus, the ink in the buffer tank is supplied to the ink jet head after the air is separated and removed in the air-liquid separation chamber.

SUMMARY

In Japanese Patent No. 4985639, the buffer tank arranged above the ink jet head includes the six air-liquid separation chambers aligned in the scanning direction in correspondence to the six ink introduction ports of the ink jet head. Here, as the ink is consumed by the ink jet head, the air (air bubbles) separated from the ink increases in the upper portion of the air-liquid separation chamber. Thus, in a case that the area of the air-liquid separation chamber is small, the air-liquid separation chamber is rapidly filled with the air. Accordingly, the area of the air-liquid separation chamber is preferred to be as large as practical. Nevertheless, in the configuration like that in Japanese Patent No. 4985639, when the area of each air-liquid separation chamber is increased, the length of the buffer tank in the scanning direction is also increased. Then, when the length of the buffer tank in the scanning direction is increased, this causes an increase in the necessary scanning range of the carriage on which the ink jet head and the buffer tank are mounted and hence directly causes a size increase in the printer body.

An object of the present disclosure is to achieve an increase in the area of the liquid chamber separating gas from liquid without the necessity of size increase of the liquid supply section in the scanning direction.

The liquid ejection device according to a first aspect is characterized by a liquid ejection device comprising: a liquid supply section including a plurality of liquid chambers respectively configured to contain plural kinds of liquids; and a liquid ejection section including plural nozzle groups of one or plural nozzle(s) and configured to eject the plural kinds of liquids to be supplied from the liquid supply section, wherein the liquid ejection section includes a plurality of supply ports which are aligned in a first direction and through which the plural kinds of liquids are supplied, wherein the liquid supply section includes: a plurality of connection passages respectively connecting the plurality of supply ports of the liquid ejection section to the liquid chambers configured to contain the liquids to be supplied respectively to the supply ports; and a plurality of air discharge passages connected respectively to the plurality of liquid chambers, and wherein the plurality of liquid chambers are aligned in a second direction intersecting with the first direction.

According to the first aspect, plural kinds of liquids introduced into the liquid supply section flow into the liquid chambers corresponding to the kinds of the liquids. Each liquid having flowed into the liquid chamber is supplied through the connection passage to the supply port of the liquid ejection section. When the liquid flows from the liquid chamber, gas mixed in the liquid is separated and left from the liquid and then collected in the upper portion of the liquid chamber. The gas is discharged through the air discharge passage connected to the liquid chamber.

Further, the plurality of supply ports of the liquid ejection section are aligned in the first direction. On the other hand, the plurality of liquid chambers connected to the plurality of supply ports are aligned in the second direction intersecting with the first direction. Thus, in a state that the size of the liquid supply section in the first direction is controlled small, the length of each liquid chamber in the first direction is allowed to be increased so that a larger area of each liquid chamber is allowed to be ensured.

According to the first aspect, the plurality of supply ports of the liquid ejection section are aligned in the first direction. In contrast to this configuration, the plurality of liquid chambers connected to the plurality of supply ports are aligned in the second direction intersecting with the first direction. Thus, in a state that the size of the liquid supply section in the first direction is controlled small, a larger area of each liquid chamber is allowed to be ensured.

The above and further objects and features will more fully be apparent from the following detailed description with accompanying drawings.

BRIEF DESCRIPTION OF THE SEVERAL VIEWS OF THE DRAWINGS

FIGS. 9A to 9D are horizontal sectional views of a distribution member according to Modification 1.

DETAILED DESCRIPTION

Figure 1:
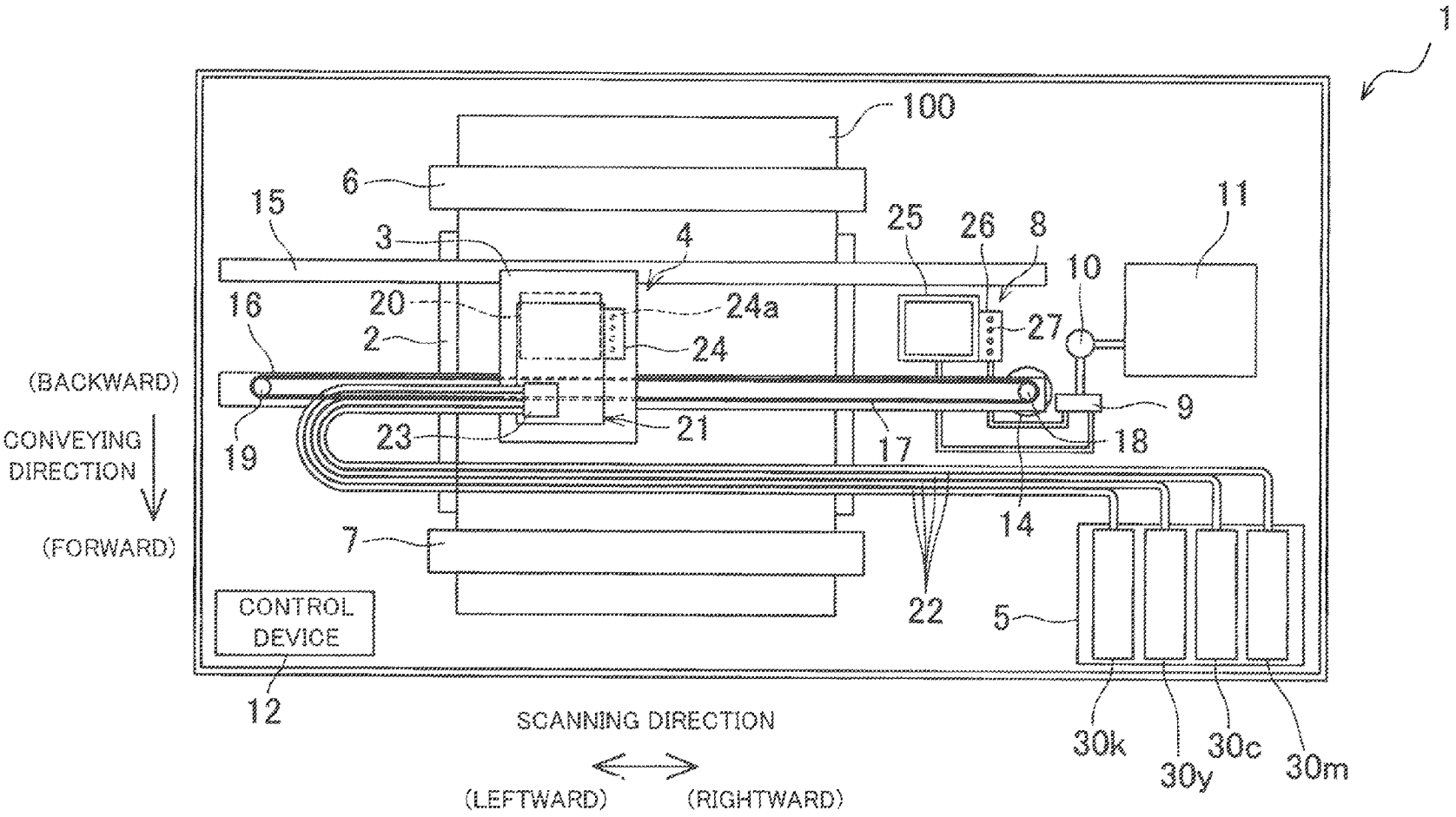
FIG. 1 is a schematic plan view of a printer according to the present embodiment.

The present embodiment is described below. FIG. 1 is a schematic plan view of a printer according to the present embodiment.

(Outline Configuration of Printer)

As illustrated in FIG. 1, a printer 1 comprises a platen 2, a carriage 3, an ink ejection device 4, a holder 5, a paper feed roller 6, a paper discharge roller 7, a cap device 8, a switching device 9, a suction pump 10, a waste liquid tank 11, and a control device 12. In the following description, the near side with respect to the paper of FIG. 1 is referred to as the "upward" of the printer 1 and the far side with respect to the paper is referred to as the "downward" of the printer 1. Further, the forward and the backward as well as the rightward and the leftward illustrated in FIG. 1 are respectively referred to as the "forward and backward directions" and the "right and left directions" of the printer 1. The following description is given by using these definitions of directions: forward, backward, rightward, leftward, upward, and downward, and the like.

A recording paper sheet 100 serving as a recording medium is placed on the upper surface of the platen 2. Further, above the platen 2, two guide rails 15 and 16 are provided that extend in to parallel to the right and left directions (also referred to as scanning direction) in FIG. 1.

The carriage 3 is attached to the two guide rails 15 and 16 and movable along the two guide rails 15 and 16 in the scanning direction in a region opposing the platen 2. Further, a drive belt 17 is attached to the carriage 3. The drive belt 17 is an endless-shaped belt wound around two pulleys 18 and 19. The pulley 18 is linked to a carriage drive motor 14. When the pulley 18 is rotated by the carriage drive motor 14, the drive belt 17 runs so that the carriage 3 performs reciprocating movement in the scanning direction.

The ink ejection device 4 (an example of the liquid ejection device) is mounted on the carriage 3. The ink ejection device 4 includes a head section 20 (an example of the liquid ejection section) and an ink supply section 21 (an example of the liquid supply section). Further, four ink cartridges 30 respectively storing inks of four colors (black, yellow, cyan, and magenta) are mounted on the holder 5 in an attachable and detachable manner. In the following description, components of the printer 1 corresponding to the inks of black (K), yellow (Y), cyan (C), and magenta (M) are designated respectively by reference numerals obtained by suitably appending "k" indicating black, "y" indicating yellow, "c" indicating cyan, and "m" indicating magenta to the reference numerals indicating these components so as to express the correspondence to which inks. For example, an ink cartridge 30*k* indicates an ink cartridge 30 storing black ink. Further, inks of three colors consisting of yellow, cyan, and magenta other than the black ink are generically referred to as "color inks", in some cases.

Figure 4:
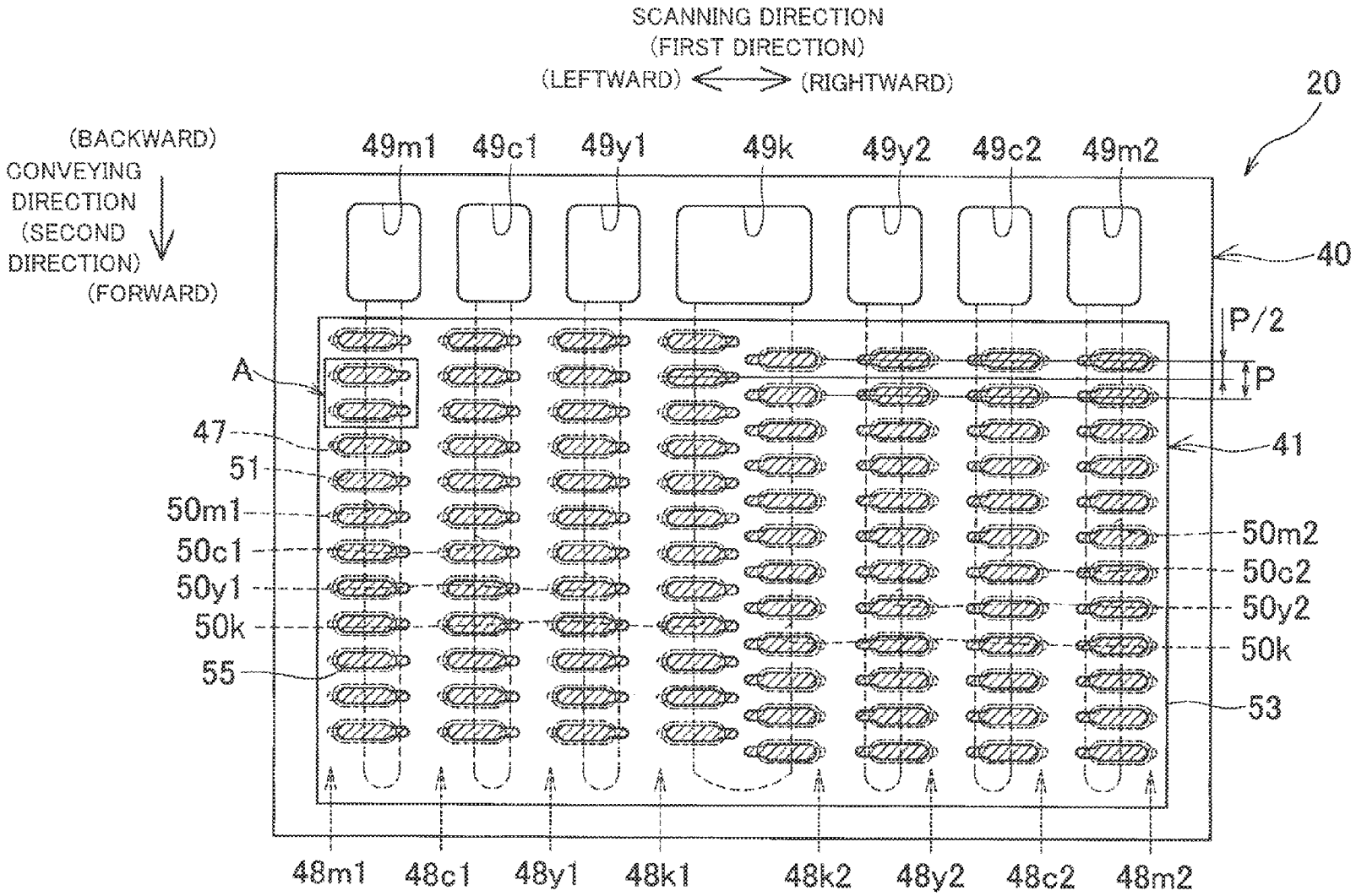
FIG. 4 is a top view of a head section.

The head section 20 includes a plurality of nozzles 47 formed in the lower surface (see FIG. 4). Then, inks are ejected through the nozzles 47. Details of the passage structure and the like of the head section 20 are described later.

The ink supply section 21 is arranged above the head section 20 and supplies the inks of four colors to the head section 20. The ink supply section 21 includes a sub tank 31. Then, the sub tank 31 is connected through a tube joint 23 to four tubes 22 that are connected to the holder 5. Here, in place of the intervention of the tube joint 23, the four tubes 22 may be connected to the sub tank 31 one by one. Further, an air discharge section 24 is provided in the sub tank 31. The air discharge section 24 is employed for discharging air in the sub tank 31 before the air moves to the head section 20. Ink passages for four colors formed in the sub tank 31 are connected respectively to four air discharge ports 24*a* of the air discharge section 24. Here, in each air discharge port 24*a*, a valve (not illustrated) is provided that switches communication and close relative to the outside.

The paper feed roller 6 and the paper discharge roller 7 are driven and rotated by a motor (not illustrated) in synchronization with each other. The paper feed roller 6 and the paper discharge roller 7 convey the recording paper sheet 100 placed on the platen 2 toward the conveying direction (forward) illustrated in FIG. 1, in cooperation with each other.

In the printer 1, in a state that the paper feed roller 6 and the paper discharge roller 7 convey the recording paper sheet 100 in the conveying direction and in a state that the ink ejection device 4 is moved in the scanning direction together with the carriage 3, the inks are ejected through the plurality of nozzles 47 of the head section 20 so that a desired image or the like is printed on the recording paper sheet 100.

The cap device 8 is arranged at a position on one side (the right-hand side) of the platen 2 in the scanning direction. The cap device 8 includes a nozzle cap 25 and an air discharge cap 26. Further, the cap device 8 is driven by a cap raising and lowering mechanism (not illustrated) and is allowed to be raised and lowered in the up and down directions (directions perpendicular to the paper of FIG. 1).

When the carriage 3 moves to the right-hand side of the platen 2, the nozzle cap 25 opposes the lower surface of the head section 20 and the air discharge cap 26 opposes the four air discharge ports 24*a* of the air discharge section 24. In this state, when the cap device 8 is raised, the cap device 8 is attached to the ink ejection device 4. At that time, the nozzle cap 25 covers the plurality of nozzles 47 of the head section 20 and the air discharge cap 26 is connected to the four air discharge ports 24*a* of the air discharge section 24. The air discharge cap 26 is provided with four bar-shaped opening and closing members 27 respectively opening and closing the valves in the four air discharge ports 24*a*. Although detailed description is omitted, in a state that the air discharge cap 26 is connected to the four air discharge ports 24*a*, the four bar-shaped opening and closing members 27 are driven up and down by a drive mechanism (not illustrated) and thereby inserted into the air discharge ports 24*a* from below so as to drive the valves provided in the air discharge ports 24*a*.

The nozzle cap 25 and the air discharge cap 26 are connected through the switching device 9 to the suction pump 10. The switching device 9 switches the destination of communication of the suction pump 10 to the nozzle cap 25 or the air discharge cap 26 and thereby allows selective execution of suction purge and air discharging purge described below.

(Suction purge) In a state that the nozzle cap 25 covers the plurality of nozzles 47 of the head section 20, the pressure in the nozzle cap 25 is reduced by the suction pump 10. Then, inks are suctioned and discharged respectively through the plurality of nozzles 47. This realizes discharging of foreign substances, air bubbles, or inks whose viscosity has been increased by drying and the like, in the head section 20.

(Air discharging purge) In a state that the air discharge cap 26 is connected to the air discharge ports 24*a* and that the valves in the air discharge ports 24*a* are opened by the opening and closing members 27, a negative pressure is applied on the air discharge ports 24*a* by the suction pump 10. By virtue of this, air in the ink supply section 21 is discharged through the air discharge ports 24*a* before the air move to the head section 20.

Here, at the time of suction purge or air discharging purge, the inks discharged from the head section 20 or the ink supply section 21 of the ink ejection device 4 are sent to the waste liquid tank 11 connected to the suction pump 10.

The control device 12 controls the above-mentioned various parts of the printer 1 so as to execute various kinds of processing such as printing on the recording paper sheet 100. For example, on the basis of a print instruction transmitted from an external device such as a personal computer, the control device 12 controls the ink ejection device 4, the carriage drive motor 14, and the like and thereby prints an image or the like on the recording paper sheet 100. Further, the control device 12 controls the switching device 9, the suction pump 10, and the like and thereby executes suction purge or air discharging purge described above.

(Details of Ink Ejection Device)

Figure 2:
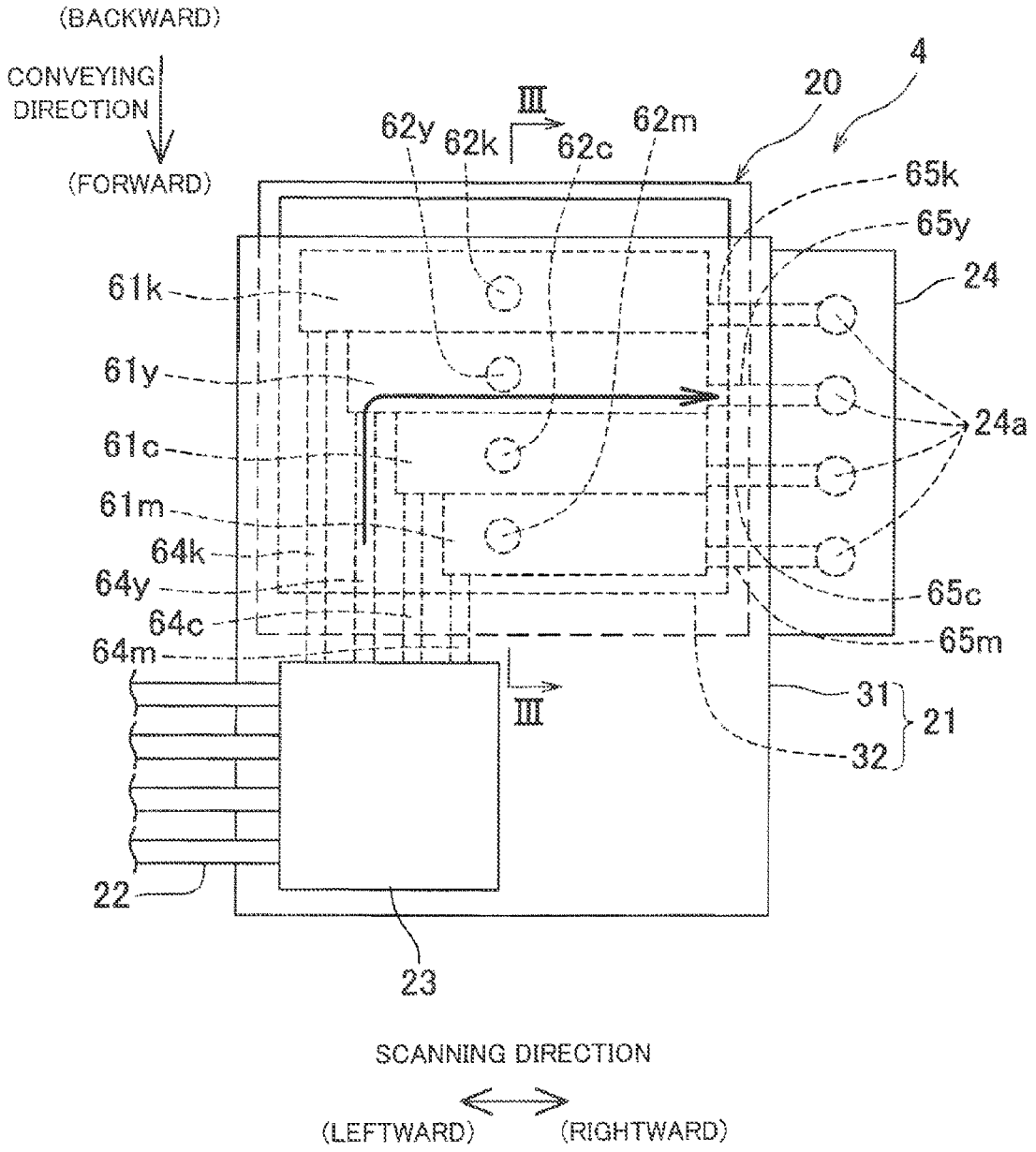
FIG. 2 is a top view of an ink ejection device.
Figure 3:
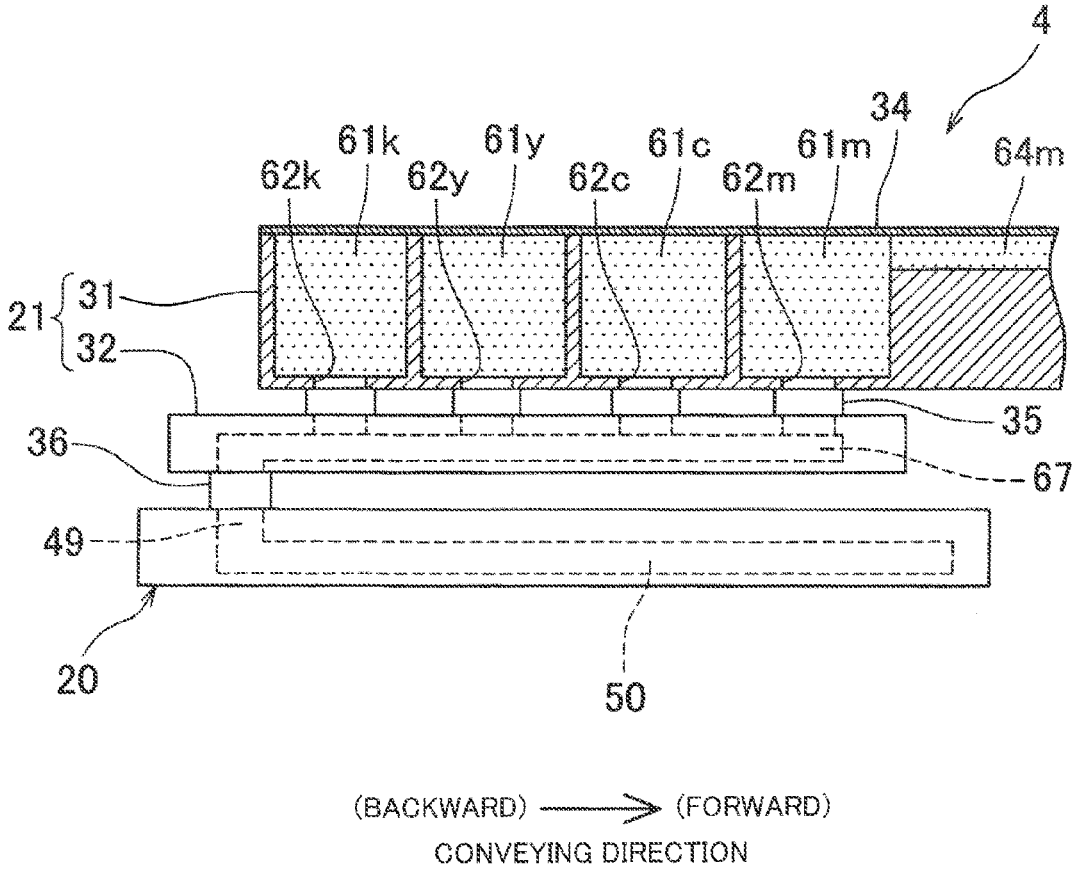
FIG. 3 is a sectional view taken along line III-III in FIG. 2.

Next, details of the configuration of the ink ejection device 4 are described below. FIG. 2 is a top view of the ink ejection device 4. FIG. 3 is a sectional view taken along line III-III in FIG. 2. As described above, the ink ejection device 4 includes the head section 20 and the ink supply section 21 arranged above the head section 20. For simplicity of the diagram, in FIG. 3, the sub tank 31 alone of the ink supply section 21 is illustrated in sectional view while the head section 20 and a distribution member 32 of the ink supply section 21 are illustrated in side view.

(Configuration of Head Section)

Figure 5A:
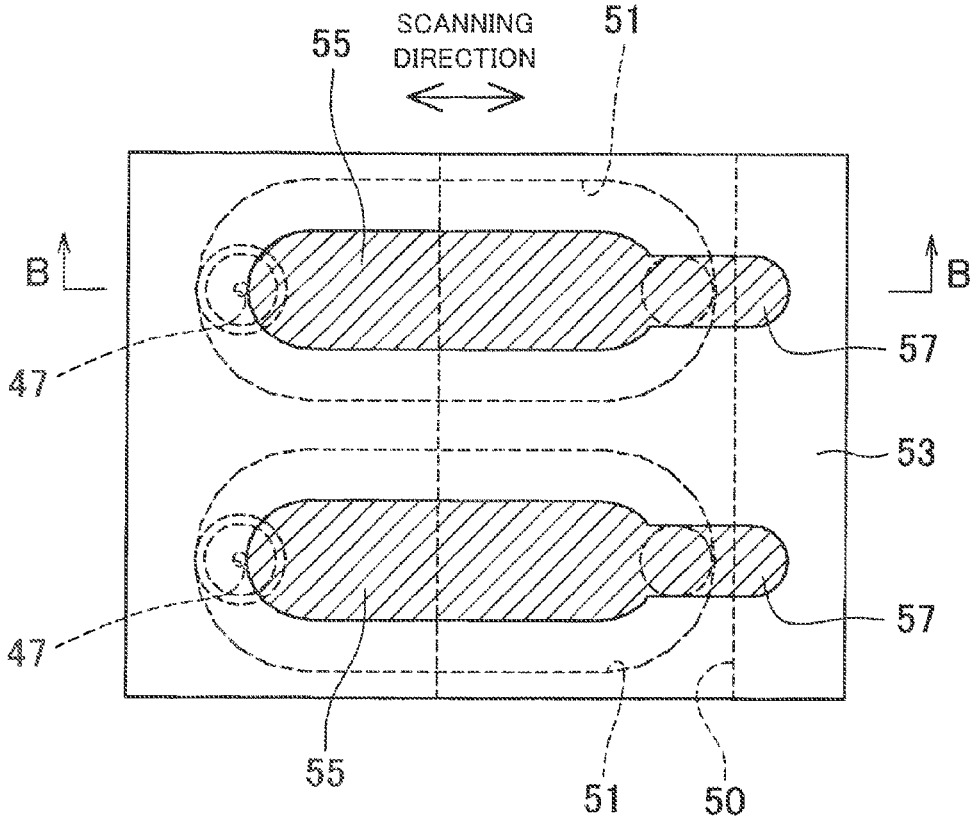
FIG. 5A is an enlarged view of part A in FIG. 4.
Figure 5B:
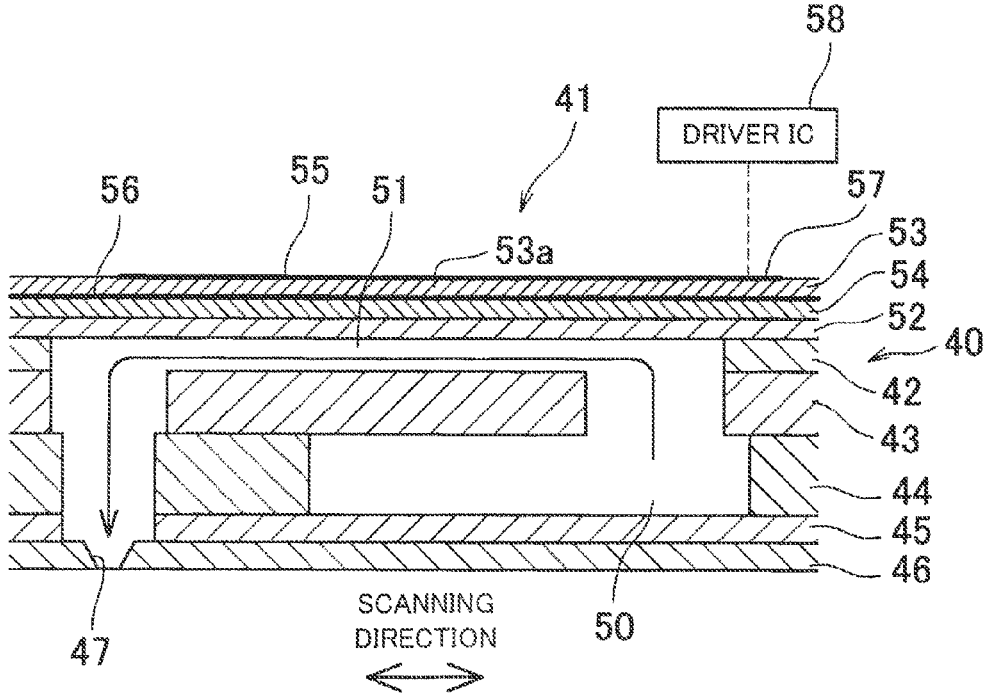
FIG. 5B is a sectional view taken along line B-B in FIG. 5A.

First, the configuration of the head section 20 is described below. FIG. 4 is a top view of the head section 20. FIG. 5A is an enlarged view of part A in FIG. 4. FIG. 5B is a sectional view taken along line B-B in FIG. 5A. As illustrated in FIGS. 4, 5A, and 5B, the head section 20 includes a passage unit 40 and a piezoelectric actuator 41.

(Passage Unit)

As illustrated in FIG. 5B, the passage unit 40 is constructed by stacking five plates 42 to 46. The lowermost plate 46 among the five plates 42 to 46 is a nozzle plate in which the plurality of nozzles 47 are formed. On the other hand, in the remaining four plates 42 to 45 on the upper side, passages such as manifolds 50 and pressure chambers 51 in communication with the plurality of nozzles 47 are formed.

With reference mainly to FIG. 4, the arrangement of the plurality of nozzles 47 formed in the nozzle plate 46 is described below. In the nozzle plate 46, the plurality of nozzles 47 are arranged with a pitch P along the conveying direction (an example of the second direction). The plurality of nozzles 47 constitute a total of eight nozzle groups 48 aligned in the scanning direction (an example of the first direction). Here, in the present embodiment, the direction (the second direction) of arrangement of the plurality of nozzles 47 is perpendicular to the scanning direction (the first direction). However, this configuration is not indispensable. That is, the direction of arrangement of the nozzles 47 may intersect with the scanning direction at an angle other than 90 degrees.

The eight nozzle groups 48 consist of two nozzle groups 48*k*1 and 48*k*2 ejecting black ink, two nozzle groups 48*y*1 and 48*y*2 ejecting yellow ink, two nozzle groups 48*c*1 and 48*c*2 ejecting cyan ink, and two nozzle groups 48*m*1 and 48*m*2 ejecting magenta ink. Here, in each two nozzle groups 48 (e.g., the two nozzle groups 48*k*1 and 48*k*2) ejecting an ink of the same color, the positions of the nozzles 47 of one group are shifted from those of the other group in the direction of arrangement of the nozzles by half the pitch P (by P/2) in each nozzle group 48.

The two nozzle groups 48*k*1 and 48*k*2 of black ink are arranged adjacent to each other in the center portion in the scanning direction. Then, the two nozzle groups 48*y*1 and 48*y*2 of yellow ink are arranged respectively on both sides of the two nozzle groups 48*k*1 and 48*k*2 of black ink in the scanning direction in a manner that the two nozzle groups 48*k*1 and 48*k*2 are located in between. Further, the two nozzle groups 48*k*1 and 48*c*2 of cyan ink are arranged on both sides of these four nozzle groups 48*k*1, 48*k*2, 48*y*1, and 48*y*2 and the two nozzle groups 48*m*1 and 48*m*2 of magenta ink are arranged on both sides of these six nozzle groups 48*k*1, 48*k*2, 48*y*1, 48*y*2, 48*c*1, and 48*c*2. That is, the nozzle groups 48 of the inks of four colors consisting of black, yellow, cyan, and magenta are arranged in left-right symmetry.

According to this configuration, in so-called bidirectional printing, when each four nozzle groups 48 provided on the left or right side are used selectively depending on the situation whether the carriage 3 moves in one of the scanning direction or in the other one of the scanning direction, each dot is formed by ejecting the inks of four colors onto the recording paper sheet 100 always in the same order (in the order of magenta, cyan, yellow, and black) regardless of the direction of moving of the carriage 3. That is, when the nozzles are arranged in the above-mentioned manner, the color texture of each dot is maintained homogeneous so that high-quality recording of an image or the like is achievable even in a case that bidirectional printing is employed that enhances the recording rate.

Here, the arrangement of the nozzle groups 48*m*, 48*c*, and 48*y* of the color inks of three colors arranged separately onto each of the right and left sides of the nozzle groups 48*k* of black ink is not limited to a left-right symmetric arrangement like that of FIG. 4 and may be changed suitably. For example, on both of the right and left sides of the nozzle groups 48*k* of black ink, the nozzle groups 48*m*, 48*c*, and 48*y* of the color inks of three colors may be arranged in the same order of magenta→cyan→yellow from left to right.

Next, the structure of the passages formed in the four plates 42 to 45 on the upper side of the passage unit 40 and formed in communication with the plurality of nozzles 47 is described below. First, as illustrated in FIG. 4, seven supply ports 49 aligned in the scanning direction are formed in the upper surface of the end part of the passage unit 40 in the upstream of the conveying direction. The supply ports 49 receives the inks of four colors supplied from the ink supply section 21 described later. The seven supply ports 49 consist of a supply port 49*k* of black ink, two supply ports 49*y*1 and 49*y*2 of yellow ink, two supply ports 49*c*1 and 49*c*2 of cyan ink, and two supply ports 49*m*1 and 49*m*2 of magenta ink. Here, FIG. 4 illustrates a mode that the seven supply ports 49 of the head section 20 are aligned in line on a plane. However, employable configurations are not limited to this arrangement. For example, the positions of the seven supply ports 49 may be somewhat different from each other in the up and down directions. Further, the seven supply ports 49 may be aligned along a direction slightly inclined from a horizontal direction (the scanning direction, the first direction).

The seven supply ports 49 are aligned in the scanning direction in the order corresponding to the above-mentioned arrangement of the nozzle groups 48 of the inks of four colors. More specifically, first, the supply port 49*k* of black ink is arranged in the center portion in the scanning direction. Then, the supply port 49*y* of yellow ink, the supply port 49*c* of cyan ink, and the supply port 49*m* of magenta ink are arranged in left-right symmetry in the order of the supply port 49*y* of yellow ink, the supply port 49*c* of cyan ink, and the supply port 49*m* of magenta ink starting at the vicinity of the supply port 49*k* of black ink toward each of the outer sides (both left and right sides) in the scanning direction. That is, the two supply ports 49*y* of yellow ink are arranged in a manner that the supply port 49*k* of black ink is located in between in the scanning direction. Then, the two supply ports 49*c* of cyan ink are arranged in a manner that the three supply ports 49*k* and 49*y* are located in between in the scanning direction. Further, the two supply ports 49*m* of magenta ink are arranged in a manner that the five supply ports 49*k*, 49*y*, and 49*c* are located in between in the scanning direction. Here, the supply port 49*k* of black ink has a larger hole size than the other six supply ports 49 because the black ink need be supplied to both of the two nozzle groups 48*k*1 and 48*k*2.

Further, in the passage unit 40, seven manifolds 50 (an example of the common passage) are formed that extend respectively in the conveying direction. The backward end parts of the seven manifolds 50 are connected respectively to the seven supply ports 49. The manifold 50*k* receives black ink supplied through the supply port 49*k*. Further, the manifolds 50*y*1 and 50*y*2 receive yellow ink supplied through the supply ports 49*y*1 and 49*y*2. The manifolds 50*c*1 and 50*c*2 receive cyan ink supplied through the supply ports 49*c*1 and 49*c*2. The manifolds 50*m*1 and 50*m*2 receive magenta ink supplied through the supply ports 49*m*1 and 49*m*2. Here, as for the passage of black ink, similarly to the passages of the other inks, two supply ports 49*k* may be provided respectively in correspondence to the two nozzle groups 48*k*1 and 48*k*2 and, similarly, two manifolds 50*k* may be provided.

The manifolds 50 of the inks of four colors consisting of black, yellow, cyan, and magenta are arranged in left-right symmetry similarly to the above-mentioned nozzle groups 48 of the inks of four colors. That is, the manifold 50*k* of black ink is arranged in the center portion in the scanning direction. Then, the two manifolds 50*y*1 and 50*y*2 of yellow ink are arranged respectively on both sides of the manifold 50*k* in a manner that the manifold 50*k* is located in between. The two manifolds 50*c*1 and 50*c*2 of cyan ink are arranged respectively on both sides of the manifolds 50*k* and 50*y* and the two manifolds 50*m*1 and 50*m*2 of magenta ink are arranged respectively on both sides of the manifolds 50*k*, 50*y*, and 50*c*.

Further, the passage unit 40 includes the plurality of pressure chambers 51 respectively corresponding to the plurality of nozzles 47. The plurality of pressure chambers 51 are formed in the plate 42 located as the uppermost layer of the passage unit 40 and arranged respectively in correspondence to the plurality of nozzles 47. As illustrated in FIG. 4, the pressure chambers 51 are arranged at positions above the manifolds 50 in eight rows along the conveying direction respectively in correspondence to the eight nozzle groups 48. Here, the two nozzle groups 48*k*1 and 48*k*2 of black ink are arranged adjacent to each other in the scanning direction. Further, the pressure chamber rows of two rows corresponding to the two nozzle groups 48*k*1 and 48*k*2 are also adjacent to each other. Thus, both of the two pressure chamber rows of black ink are in communication with one manifold 50*k* located immediately thereunder. On the other hand, as for the pressure chamber rows corresponding to the other nozzle groups 48, each pressure chamber row is in communication with one manifold 50 located immediately thereunder. According to this configuration, as indicated by an arrow in FIG. 5B, in the passage unit 40, a plurality of individual passages are formed each of which branches from each manifold 50 and then goes through the pressure chamber 51 to the nozzle 47.

(Piezoelectric Actuator)

The piezoelectric actuator 41 is joined to the upper surface of the passage unit 40 such as to cover the plurality of pressure chambers 51. As illustrated in FIGS. 4, 5A, and 5B, the piezoelectric actuator 41 includes an ink sealing film 52, two piezoelectric layers 53 and 54, a plurality of individual electrodes 55, and a common electrode 56.

The ink sealing film 52 is composed of a thin film fabricated from a material having low ink permeability, for example, a metallic material such as stainless steel. The ink sealing film 52 is joined to the upper surface of the passage unit 40 such as to cover the plurality of pressure chambers 51.

The two piezoelectric layers 53 and 54 are respectively fabricated from a piezoelectric material containing, as a main component, lead zirconate titanate which is mixed crystal of lead titanate and lead zirconate. The piezoelectric layers 53 and 54 are arranged on the upper surface of the ink sealing film 52 with the piezoelectric layers 53 and 54 being stacked with each other.

The plurality of individual electrodes 55 are arranged on the upper surface of the upper piezoelectric layer 53. More specifically, as illustrated in FIGS. 4, 5A, and 5B, each of the individual electrodes 55 is arranged in a region of the upper surface of the piezoelectric layer 53 that opposes the center portion of the pressure chamber 51. The plurality of individual electrodes 55 are arranged in correspondence to the plurality of pressure chambers 51 and hence constitute a total of eight individual electrode rows. An individual terminal 57 extends from each of the individual electrodes 55. The plurality of individual terminals 57 are connected to a wiring member (not illustrated) on which a driver IC 58 is mounted. According to this configuration, the plurality of individual electrodes 55 are electrically connected to the driver IC 58. Each of the individual electrodes 55 receives a predetermined drive potential or a ground potential selectively applied by the driver IC 58.

The common electrode 56 is arranged between the two piezoelectric layers 53 and 54. The common electrode 56 opposes the plurality of individual electrodes 55 with the piezoelectric layer 53 in between. Although illustration of a detailed electric connection structure is omitted, a connection terminal extends also from the common electrode 56 to the upper surface of the piezoelectric layer 53. Then, similarly to the plurality of individual electrodes 55, the connection terminal is connected to a wiring member (not illustrated). The common electrode 56 is connected to a ground wiring formed in the wiring member so that the potential of the common electrode 56 is maintained always at the ground potential.

Here, a part of the piezoelectric layer 53 (referred to as an active part 53*a*) located between the individual electrode 55 and the common electrode 56 is polarized in the thickness direction (downward). The active part 53*a* is a part where a potential difference is generated between the individual electrode 55 and the common electrode 56 so that an electric field generates in the thickness direction and causes a piezoelectric deformation (piezoelectric strain).

The operation of the piezoelectric actuator 41 is described below. When the driver IC 58 applies a drive potential onto a given individual electrode 55, a potential difference arises between this individual electrode 55 and the common electrode 56. At that time, an electric field generates on the active part 53*a* of the piezoelectric layer 53 in the thickness direction (downward). The direction of the electric field agrees with the direction of polarization of the active part 53*a*. Thus, the active part 53*a* is contracted in the plane direction. Then, in association with the contraction of the active part 53*a*, a deformation so as to be convex toward the pressure chamber 51 is generated in the two piezoelectric layers 53 and 54. This causes a change in the volume of the pressure chamber 51 and hence generates a pressure wave in the individual passage including the pressure chamber 51. By virtue of this, ejection energy is imparted to the ink so that a droplet of the ink is ejected through the nozzle 47.

(Configuration of Ink Supply Section)

Next, the ink supply section 21 is described below. As illustrated in FIGS. 2 and 3, the ink supply section 21 includes the sub tank 31 and the distribution member 32.

The sub tank 31 is a member formed from synthetic resin or the like and having a rectangular shape in plan view. The sub tank 31 includes four ink chambers 61 (an example of the liquid chambers) respectively containing the inks of four colors. As illustrated in FIG. 2, each ink chamber 61 has, in plan view, a rectangular shape elongated in the scanning direction. The four ink chambers 61 are aligned in the order of black, yellow, cyan, and magenta along the conveying direction. Here, the lengths of the four ink chambers 61 in the scanning direction are shorter in the order of arrangement of the ink chambers 61 toward the downstream (the forward side) of the conveying direction. Further, the four ink chambers 61 have mutually the same length in the conveying direction. Thus, the areas of the four ink chambers 61 are smaller in the order of arrangement of the ink chambers 61 toward the downstream of the conveying direction. Further, the four ink chambers 61 are respectively located on right side of the sub tank 31 in alignment with each other and hence the positions of the right ends thereof in the scanning direction are aligned with each other. Here, FIG. 2 illustrates a mode that the four ink chambers 61 are aligned in line on a plane. However, employable configurations are not limited to this arrangement. That is, the positions of the four ink chambers 61 may be somewhat different in the up and down directions. Further, the four ink chambers 61 may be aligned along a direction slightly inclined from a horizontal direction (the conveying direction, the second direction).

In a portion of the sub tank 31 on the forward side relative to the four ink chambers 61, four ink introduction passages 64 (an example of the liquid introduction sections) are formed that respectively extend in the conveying direction and are connected respectively to the four ink chambers 61. Further, the tube joint 23 is attached to the upper surface of the left half part of the forward end part of the sub tank 31. The four ink introduction passages 64 are respectively connected through the tube joint 23 and the four tubes 22 to the four ink cartridges 30 (an example of the liquid storage sections; see FIG. 1) mounted on the holder 5. Further, as described above, since the four ink chambers 61 are located on the right side of the sub tank 31 in alignment with each other, a vacant region is present on the left side of the ink chambers 61 located on the more forward side and having the shorter lengths in the scanning direction. In this region, ink introduction passages 64 are arranged for introducing the inks to the ink chambers 61 arranged on the more backward side. That is, the ink chambers 61 located on the more forward side (e.g., the ink chamber 61*m*) and the ink introduction passages 64 (the ink introduction passages 64*k*, 64*y*, and 64*c*) connected to the ink chambers 61 located on the backward side relative to the ink chambers 61 located on the more forward side (the ink chamber 61*m*) are aligned in the scanning direction.

In the lower wall of the sub tank 31, four ejection holes 62 are formed that are respectively in communication with the four ink chambers 61. The four ejection holes 62 are aligned in the forward and backward directions in the center portion of the scanning direction of the sub tank 31 in accordance with the order of arrangement of the four ink chambers 61. The inks of four colors contained in the four ink chambers 61 are sent through the four ejection holes 62 to the distribution member 32 arranged under the ejection holes 62 and described later.

In the right end part of the sub tank 31, four air discharge passages 65 are formed that are connected respectively to the four ink chambers 61. Further, the air discharge section 24 is provided in the right side-surface of the sub tank 31. The four air discharge passages 65 are connected respectively to the four air discharge ports 24*a* of the air discharge section 24.

Here, as illustrated in FIG. 3, the ink chambers 61, the ink introduction passages 64, and the air discharge passages 65 described above are concave passages opened upward. Then, in a manner of covering the concave passages together from above, a flexible damper film 34 composed of a synthetic resin film or the like is provided almost over the entirety of the upper surface of the sub tank 31. Each ink chamber 61 is covered by the damper film 34 from above, and thereby each ink chamber 61 serves also as a damper chamber attenuating a pressure fluctuation in the ink.

Figure 6:
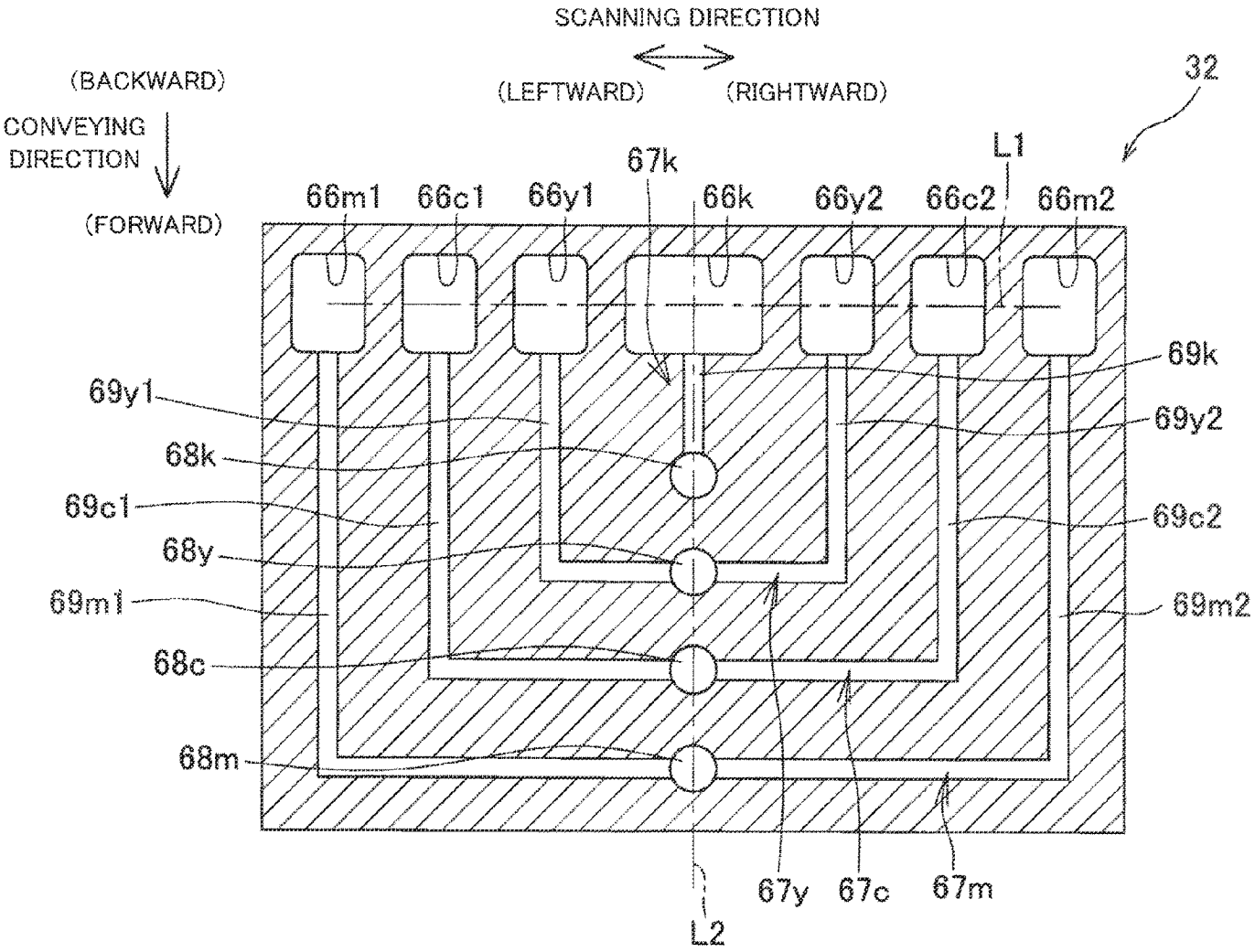
FIG. 6 is a horizontal sectional view of a distribution member.

As illustrated in FIGS. 2 and 3, the distribution member 32 is a member having a rectangular shape in plan view and arranged between the head section 20 and the sub tank 31. The distribution member 32 is connected through communicating members 35 to the ejection holes 62 of the sub tank 31. Further, the distribution member 32 is connected also to the supply ports 49 of the head section 20 through communicating members 36. FIG. 6 is a horizontal sectional view of the distribution member 32.

As illustrated in FIGS. 3 and 6, in the backward end part of the distribution member 32, seven ink discharge ports 66 are formed that are arranged respectively at positions immediately above the seven supply ports 49 of the head section 20 and aligned in the scanning direction. The seven ink discharge ports 66 are respectively connected through the communicating members 36 to the seven ink supply ports 49 of the head section 20.

Further, the distribution member 32 includes four connection passages 67 supplying the inks of four colors sent from the four ink chambers 61 of the sub tank 31 through the ejection holes 62, respectively to the seven supply ports 49 of the head section 20. Each of the four connection passages 67 includes a communicating hole 68 in communication with the ejection hole 62 of the sub tank 31 and a supply passage(s) 69 connecting the communicating hole 68 to the ink discharge port(s) 66. The four communicating holes 68 are aligned in the forward and backward directions in correspondence to the arrangement of the four ejection holes 62 of the sub tank 31 in the center portion of the scanning direction of the distribution member 32.

Among the four communicating holes 68, the communicating hole 68*k* of black ink is located on the most backward side. Then, one supply passage 69*k* extends backward from the communicating hole 68*k*. The one supply passage 69*k* is connected to the ink discharge port 66*k* of black ink. Here, the connection passage 67*k* of black ink is an example of the first connection passage and the supply port 49*k* of black ink is an example of the first supply port. Further, the ink chamber 61*k* of black ink is an example of the first liquid chamber.

On the other hand, two supply passages 69 extend in the right and left directions from each of the communicating hole 68*y* of yellow ink, the communicating hole 68*c* of cyan ink, and the communicating hole 68*m* of magenta ink. Further, each of the supply passages 69 is bent in the middle so as to extend backward and then is connected to the ink discharge port 66. That is, the two supply passages 69*y*1 and 69*y*2 of yellow ink are connected respectively to the two ink discharge ports 66*y*1 and 66*y*2 of yellow ink. Similarly, the two supply passages 69*c*1 and 69*c*2 of cyan ink are connected respectively to the two ink discharge ports 66*c*1 and 66*c*2 of cyan ink, and the two supply passages 69*m*1 and 69*m*2 of magenta ink are connected respectively to the two air discharge ports 66*m*1 and 66*m*2 of magenta ink. Here, each of the connection passages 67*y*, 67*c*, and 67*m* of the color inks of three colors is an example of the second connection passage. The communicating holes 68*y*, 68*c*, and 68*m* are an example of the communicating parts. The supply passages 69*y*1, 69*y*2, 69*c*1, 69*c*2, 69*m*1, and 69*m*2 are an example of the branched passages. Further, each of the supply ports 49*y*1, 49*y*2, 49*c*1, 49*c*2, 49*m*1, and 49*m*2 of color inks is an example of the second supply port and each ink chamber 61*y*, 61*c*, and 61*m* of color inks is an example of the second liquid chamber.

As illustrated in FIG. 6, when viewed in the up and down directions, the structure of the passages in the distribution member 32 respectively supplying the ink to the two ink supply ports 49 through which the ink of the same color is supplied is of left-right symmetry. That is, the communicating hole 68*m* of magenta ink is arranged on a straight line L2 perpendicular to a line segment L1 joining the two ink supply ports 49*m*1 and 49*m*2 (the ink discharge ports 66*m*1 and 66*m*2) of magenta ink. Then, the two supply passages 69*m*1 and 69*m*2 of magenta ink are in line symmetry with respect to the straight line L2. The passages of yellow ink and of cyan ink also have a passage structure of line symmetry similar to that of magenta ink. According to this configuration, the difference in the passage resistance between the two supply passages 69 for the ink of the same color is reduced and hence the difference in the passage resistance between the two passages respectively from one ink chamber 61 to two supply ports 49 is reduced.

In the ink supply section 21 described above, the ink sent from the ink cartridge 30 through the tube 22 to the sub tank 31, first, flows into the ink chamber 61 corresponding to the ink. Then, the ink having flowed into the ink chamber 61 is supplied through the connection passage 67 in the distribution member 32 to the supply port 49 of the head section 20. Here, when air is mixed in the ink supplied through the tube 22 and then the air flows into the head section 20, this could cause ejection failure in the nozzles 47. In this point, in the present embodiment, the ink chamber 61 is present in the upstream of the head section 20. Thus, at the time that the ink flows from the ink chamber 61 to the connection passage 67 of the distribution member 32 in the downstream, the air mixed in the ink is separated from the ink and then left in the upper portion of the ink chamber 61. Accordingly, the ink from which air has been separated and removed is supplied from the ink chamber 61 through the connection passage 67 of the distribution member 32 to the head section 20. Here, the air once separated from the ink is collected in the upper portion of the ink chamber 61. Thus, the air in the ink chamber 61 does not flow into the head section 20 even when the ink is later supplied to the ink chamber 61.

Nevertheless, in association with the consumption of the ink in the head section 20, the air separated from the ink is continuously collected in the ink chamber 61 and hence the air collected in the upper portion of the ink chamber 61 continues to increase. Then, when the ink chamber 61 is filled up with the air, a part of the air flows through the connection passage 67 to the head section 20. Thus, at each time that a fixed time has elapsed, the above-mentioned air discharging purge is performed so that the air collected in the ink chamber 61 is discharged through the air discharge port 24*a* of the air discharge section 24 via the air discharge passage 65.

As described above, in the present embodiment, the four ink chambers 61 of the sub tank 31 are aligned in the conveying direction intersecting with (perpendicular to) the up and down directions and with the scanning direction which is the direction of arrangement of the seven supply ports 49. By virtue of this, without the necessity of size increase in the scanning direction in the sub tank 31, the length of each ink chamber 61 in the scanning direction is allowed to be increased and hence a larger area of each ink chamber 61 is ensured.

Figure 7:
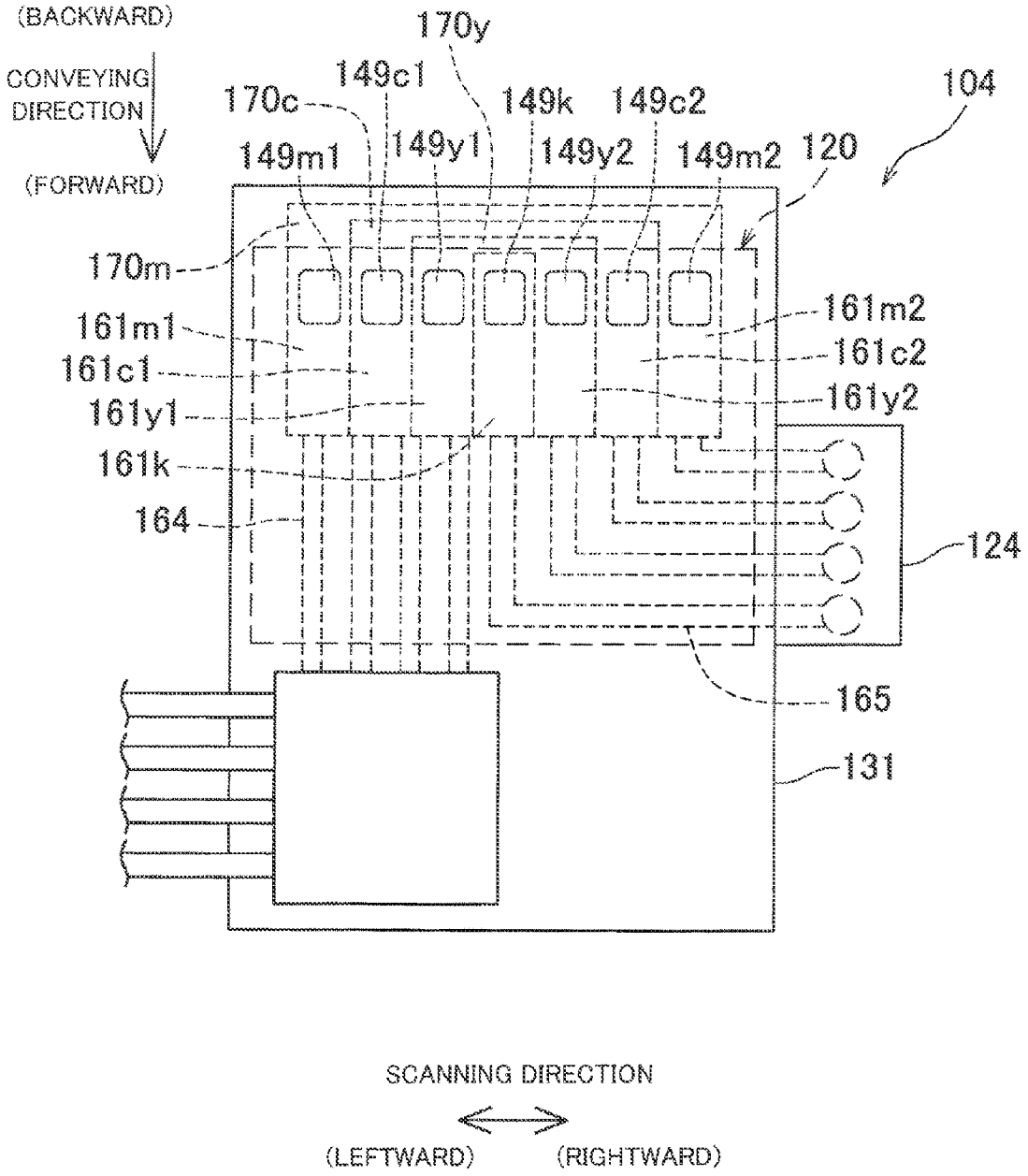
FIG. 7 RELATED ART
FIG. 7 is a top view of an ink ejection device constructed such that ink chambers in the same number as supply ports are aligned in the scanning direction.

Further, in the present embodiment, the ink chambers 61 of the color inks of three colors have a configuration that an ink of the same color from one ink chamber 61 elongated in the scanning direction is supplied and distributed to the two supply ports 49 of the head section 20. In this point, like in the conventional art, an alternative configuration may be employed that two ink chambers are aligned in the scanning direction correspondingly respectively to the two supply ports through which the ink of the same color is supplied. Here, an advantage of the configuration of the present embodiment over the alternative configuration is described below. FIG. 7 is a top view of the ink ejection device 104 constructed such that the ink chambers 161 in the same number as the supply ports 149 are aligned in the scanning direction. In FIG. 7, the sub tank 131 includes seven ink chambers 161 respectively corresponding to the seven supply ports 149 of the head section 20. Then, the seven ink chambers 161 are aligned in the scanning direction.

In the configuration illustrated in FIG. 7, first, the seven ink chambers 161 are aligned in the scanning direction. Thus, the width of each ink chamber 161 in the scanning direction is rather narrow and hence the area is also small. In addition to this problem, the following problem also arises. That is, in order that a satisfactory air discharge property should be achieved for the air collected respectively in two ink chambers 161 (e.g., the ink chambers 161*y*1 and 161*y*2 of yellow ink) containing an ink of the same color, it is desired that the two ink chambers 161 are linked to each other such that a continuous air flow occurs from the upstream of the two ink chambers 161, sequentially through the two ink chambers 161 through the air discharge passage 165 to the air discharge section 124. Nevertheless, since the ink chamber 161 of black ink is present between the two ink chambers 161, the link passage 170 linking the two ink chambers 161 of the ink of the same color need be arranged on the outer side of these ink chambers 161 such as to avoid the seven ink chambers 161. For example, in FIG. 7, the link passages 170*y*, 170*c*, and

170*m* are arranged on the upstream side of the conveying direction relative to the seven ink chambers 161. This arrangement of the link passages 170 causes a size increase in the sub tank 31 in plan view.

In this point, in the present embodiment, as illustrated in FIG. 2, one ink chamber 61 is provided for each ink of any color and then the four ink chambers 61 are aligned in the conveying direction. By virtue of this, the length of each ink chamber 61 in the scanning direction is allowed to be increased and then the ink of the same color is allowed to be supplied from one ink chamber 61 respectively to the two supply ports 49 aligned in the scanning direction. That is, in this configuration, the ink chamber 61 is shared by the two supply ports 49 for the ink of the same color. This avoids the necessity of the link passages 170 in FIG. 7 and hence the passage structure is simplified. Further, as indicated by an arrow in FIG. 2, the ink passage of each color in the sub tank 31 becomes a single passage extending from the ink introduction passage 64 through the ink chamber 61 to the air discharge passage 65 without branching in the middle. Thus, the air continuously flows with ease and hence the air discharge property in the sub tank 31 is improved.

Further, as illustrated in FIG. 2, the lengths of the four ink chambers 61 in the scanning direction are shorter as the ink chambers 61 are located on the more forward side (on a side closer to the ink introduction passages 64). Then, the ink chambers 61 located on the more forward side and the ink introduction passages 64 connected to the ink chambers 61 located on the more backward side are aligned in the scanning direction. By virtue of this, the four ink chambers 61 and the four ink introduction passages 64 supplying the inks respectively to the four ink chambers 61 are allowed to be arranged compact.

Further, in the present embodiment, as illustrated in FIG. 3, the damper film 34 is provided as an upper wall of the sub tank 31 (a part of the wall) forming the ink chambers 61. Thus, each ink chamber 61 serves also as a damper chamber attenuating a pressure fluctuation in the ink. In order to improve the effect of attenuating the pressure fluctuation in the damper chamber, it is preferable to increase the area of the damper chamber as large as practical. In this point, as described above, when the configuration is employed that the four ink chambers 61 are aligned in the conveying direction, a larger area of each ink chamber 61 serving as the damper chamber is ensured. Further, the ink chamber 61 separating air from the ink serves also as a damper chamber, thereby further size reduction is allowed in the ink supply section 21 in comparison with a configuration that a damper chamber is provided independently. Further, like in FIG. 7, in the configuration that the seven ink chambers 161 are aligned in the scanning direction, when the area of each ink chamber 161 is increased in order that each ink chamber 161 should serve also as a damper chamber, this causes a remarkable size increase in the sub tank 131 in the scanning direction. In this point, in the present embodiment, since the four ink chambers 61 are aligned in the conveying direction, the size increase in the sub tank 31 in the scanning direction is allowed to be controlled even in a state that the area of each ink chamber 61 is increased and hence the function of a damper chamber is achieved.

Next, modifications obtained by adding various changes to the above-mentioned embodiment are described below. Here, like components to those in the above-mentioned embodiment are designated by like numerals and hence their description is omitted appropriately.

(Modification 1)

Although in the above-mentioned embodiment, the supply ports 49 of the passage unit 40 and the ink discharge ports 66 of the distribution member 32 are arranged in the end part thereof in the upstream (backward side) of the conveying direction, in Modification 1 the supply ports 49 and the ink discharge ports 66 are arranged in the both end parts thereof in the conveying direction. In such a configuration, the distribution member 32 is constructed so as to be provided with a plurality of layers.

Figure 8:
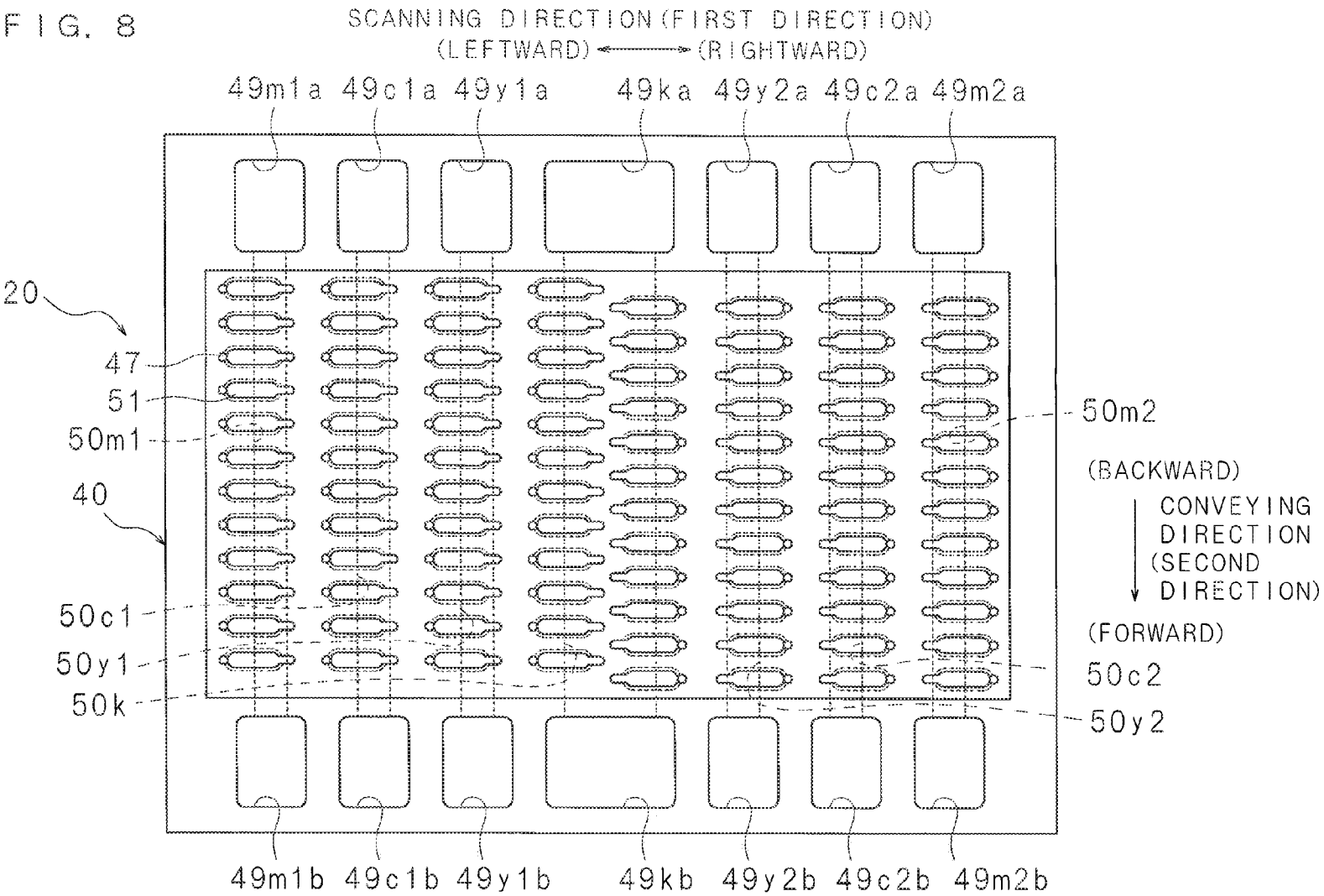
FIG. 8 is a top view of a head section according to Modification 1.

FIG. 8 is a top view of a head section according to Modification 1, and FIGS. 9A to 9D are horizontal sectional views of a distribution member 32 according to Modification 1.

As illustrated in FIG. 8, seven supply ports 49 through which magenta ink, cyan ink, yellow ink and black ink flow are aligned in the scanning direction in the end part of the passage unit 40 in the upstream of the conveying direction. The seven supply ports 49 consist of a supply port 49*ka* of black ink, two supply ports 49*y*1*a* and 49*y*2*a* of yellow ink, two supply ports 49*c*1*a* and 49*c*2*a* of cyan ink, and two supply ports 49*m*1*a* and 49*m*2*a* of magenta ink. Also, seven supply ports 49 through which magenta ink, cyan ink, yellow ink and black ink flow are aligned in the scanning direction in the end part of the passage unit 40 in the downstream of the conveying direction. The seven supply ports 49 consist of a supply port 49*kb* of black ink, two supply ports 49*y*1*b* and 49*y*2*b* of yellow ink, two supply ports 49*c*1*b* and 49*c*2*b* of cyan ink, and two supply ports 49*m*1*b* and 49*m*2*b* of magenta ink. The order in which these supply ports are arranged is similar to that in the above-mentioned embodiment, and the supply ports 49*ka* and 49*kb* of black ink are arranged in the center portion in the scanning direction. The supply ports 49*y*1*a*, 49*y*2*a*, 49*y*1*b*, 49*y*2*b* of yellow ink, the supply ports 49*c*1*a*, 49*c*2*a*, 49*c*1*b*, 49*c*2*b* of cyan ink, and the supply ports 49*m*1*a*, 49*m*2*a*, 49*m*1*b*, 49*m*2*b* of magenta ink are arranged in left-right symmetry in the order of the supply ports of yellow ink, the supply ports of cyan ink, and the supply ports of magenta ink starting at the vicinity of the supply ports 49*ka* and 49*kb* of black ink toward each of the outer sides (both left and right sides) in the scanning direction. In such a configuration, the supply ports 49 arranged in the both end parts in the conveying direction are formed in the both end parts of the manifolds 50.

As illustrated in FIGS. 9A to 9D, the distribution member 32 is provided as the plurality of layers with four plates 32*m*, 32*c*, 32*y*, 32*k* and three films (not illustrated) which are arranged between two plates of the four plates, respectively. Communicating hole(s) and ink discharge ports are formed in the four plates 32*m*, 32*c*, 32*y*, 32*k* and three films, respectively. After the four plates 32*m*, 32*c*, 32*y*, 32*k* and three films are stacked, the communicating holes are communicated with each other for each color and the ink discharge ports are communicated with each other for each color, so as to constitute passages through which inks flow.

As illustrated in FIG. 9A, the plate arranged as the lowermost layer among the four plates is a plate 32*m*, and seven ink discharge ports 66 through which magenta ink, cyan ink, yellow ink and black ink flow are aligned in the scanning direction in the end part of the plate 32*m* arranged as the lowermost layer in the upstream of the conveying direction. The seven ink discharge ports 66 consist of an ink discharge port 66*kma* of black ink, two ink discharge ports 66*y*1*ma* and 66*y*2*ma* of yellow ink, two ink discharge ports 66*c*1*ma* and 66*c*2*ma* of cyan ink, and two ink discharge ports 66*m*1*ma* and 66*m*2*ma* of magenta ink. Also, seven ink discharge ports 66 through which magenta ink, cyan ink, yellow ink and black ink flow are aligned in the scanning direction in the end part of the plate 32*m* in the downstream of the conveying direction. The seven ink discharge ports 66 consist of an ink discharge port 66*kmb* of black ink, two ink discharge ports 66*y*1*mb* and 66*y*2*mb* of yellow ink, two ink discharge ports 66*c*1*mb* and 66*c*2*mb* of cyan ink, and two ink discharge ports 66*m*1*mb* and 66*m*2*mb* of magenta ink. The ink discharge ports are arranged in left-right symmetry in the order of yellow, cyan and magenta while the ink discharge ports of black ink are centrally arranged.

In the plate 32*m*, a H-shaped connection passage 67*m* is formed that is a passage for magenta ink. The H-shaped connection passage 67*m* is of left-right symmetry with respect to a line segment L2 joining the two ink discharge ports 66*kma* and 66*kmb* of black ink. The connection passage 67*m* includes a communicating hole 68*mm* in communication with the ejection hole 62*m* of the sub tank 31 and a supply passage 69*m* connecting the communicating hole 68*mm* to the four ink discharge ports 66*m*1*ma*, 66*m*2*ma*, 66*m*1*mb*, 66*m*2*mb*. The communicating hole 68*mm* is arranged on the line segment L2 in the center portion in the scanning direction. The supply passage 69*m* is constructed such that two supply passages extend from the communicating hole 68*mm* on the left or right side and branch into two passages, respectively, to be connected to the ink discharge ports 66*m*1*ma*, 66*m*2*ma*, 66*m*1*mb*, 66*m*2*mb*.

As illustrated in FIG. 9B, the plate arranged as the second layer from the bottom among the four plates is a plate 32*c*, and five ink discharge ports 66 through which cyan ink, yellow ink and black ink flow are aligned in the scanning direction in the end part of the plate 32*c* in the upstream of the conveying direction. The five ink discharge ports 66 consist of an ink discharge port 66*kca* of black ink, two ink discharge ports 66*y*1*ca* and 66*y*2*ca* of yellow ink, and two ink discharge ports 66*c*1*ca* and 66*c*2*ca* of cyan ink. Also, five ink discharge ports 66 through which cyan ink, yellow ink and black ink flow are aligned in the scanning direction in the end part of the plate 32*c* in the downstream of the conveying direction. The five ink discharge ports 66 consist of an ink discharge port 66*kcb* of black ink, two ink discharge ports 66*y*1*cb* and 66*y*2*cb* of yellow ink, and two ink discharge ports 66*c*1*cb* and 66*c*2*cb* of cyan ink. The ink discharge ports are arranged in left-right symmetry in the order of yellow and cyan while the ink discharge ports of black ink are centrally arranged.

In the plate 32*c*, a H-shaped connection passage 67*c* is formed that is a passage for cyan ink. The H-shaped connection passage 67*c* is of left-right symmetry with respect to a line segment L2 joining the two ink discharge ports 66*kca* and 66*kcb* of black ink. The connection passage 67*c* includes a communicating hole 68*cc* in communication with the ejection hole 62*c* of the sub tank 31 and a supply passage 69*c* connecting the communicating hole 68*cc* to the four ink discharge ports 66*c*1*ca*, 66*c*2*ca*, 66*c*1*cb*, 66*c*2*cb*. The communicating hole 68*cc* is arranged on the line segment L2 in the center portion in the scanning direction. The supply passage 69*c* is constructed such that two supply passages extend from the communicating hole 68*cc* on the left or right side and branch into two passages, respectively, to be connected to the ink discharge ports 66*c*1*ca*, 66*c*2*ca*, 66*c*1*cb*, 66*c*2*cb*. Moreover, in the plate 32*c*, a communiting hole 68*mc* through which magenta ink flows is formed on the line segment L2 in the center portion in the scanning direction, in addition to the communicating hole 68*cc*.

As illustrated in FIG. 9C, the plate arranged as the third layer from the bottom among the four plates is a plate 32*y*, and three ink discharge ports 66 through which yellow ink and black ink flow are aligned in the scanning direction in the end part of the plate 32*y* in the upstream of the conveying direction. The three ink discharge ports 66 consist of an ink discharge port 66*kya* of black ink and two ink discharge ports 66*y*1*ya* and 66*y*2*ya* of yellow ink. Also, three ink discharge ports 66 through which yellow ink and black ink flow are aligned in the scanning direction in the end part of the plate 32*y* in the downstream of the conveying direction. The three ink discharge ports 66 consist of an ink discharge port 66*kyb* of black ink and two ink discharge ports 66*y*1*yb* and 66*y*2*yb* of yellow ink. The ink discharge ports of yellow ink are arranged in left-right symmetry on both sides of the ink discharge ports of black ink while the ink discharge ports of black ink are centrally arranged.

In the plate 32*y*, a H-shaped connection passage 67*y* is formed that is a passage for yellow ink. The H-shaped connection passage 67*y* is of left-right symmetry with respect to a line segment L2 joining the two ink discharge ports 66*kya* and 66*kyb* of black ink. The connection passage 67*y* includes a communicating hole 68*yy* in communication with the ejection hole 62*y* of the sub tank 31 and a supply passage 69*y* connecting the communicating hole 68*yy* to the four ink discharge ports 66*y*1*ya*, 66*y*2*ya*, 66*y*1*yb*, 66*y*2*yb*. The communicating hole 68*yy* is arranged on the line segment L2 in the center portion in the scanning direction. The supply passage 69*y* is constructed such that two supply passages extend from the communicating hole 68*yy* on the left or right side and branch into two passages, respectively, to be connected to the ink discharge ports 66*y*1*ya*, 66*y*2*ya*, 66*y*1*yb*, 66*y*2*yb*. Moreover, in the plate 32*y*, a communicating hole 68*my* through which magenta ink flows and a communicating hole 68*cy* through which cyan ink flows are formed on the line segment L2 in the center portion in the scanning direction, in addition to the communicating hole 68*yy*.

As illustrated in FIG. 9D, the plate arranged as the uppermost layer among the four plates is a plate 32*k*, and an ink discharge port 66*kka* through which black ink flows is arranged in the end part of the plate 32*k* in the upstream of the conveying direction, and an ink discharge port 66*kkb* through which black ink flows is arranged in the end part of the plate 32*k* in the downstream of the conveying direction. In the plate 32*k*, a connection passage 67*k* is formed that is a passage for black ink. The connection passage 67*k* includes a communicating hole 68*kk* in communication with the ejection hole 62*k* of the sub tank 31 and a supply passage 69*k* connecting the communicating hole 68*kk* to the two ink discharge ports 66*kka* and 66*kkb*. The communicating hole 68*kk* is arranged on a line segment L2 joining the two ink discharge ports 66*kka* and 66*kkb* of black ink in the center portion in the scanning direction. The supply passage 69*k* includes a supply passage extending from the communicating hole 68*kk* to the ink discharge port 66*kka* and a supply passage extending from the communicating hole 68*kk* to the ink discharge port 66*kkb*. Moreover, in the plate 32*k*, a communicating hole 68*mk* through which magenta ink flows, a communicating hole 68*ck* through which cyan ink flows and a communicating hole 68*yk* through which yellow ink flows are formed on the line segment L2 in the center portion in the scanning direction, in addition to the communicating hole 68*kk*. The supply passage extending from the communicating hole 68*kk* to the ink discharge port 66*kkb* is bent so as to avoid these communicating holes.

After the four plates 32*m*, 32*c*, 32*y*, 32*k* constructed in the above manner and the three films (not illustrated) which are arranged between two plates of the four plates, respectively are stacked, the ink discharge ports 66 formed in the respective plates are communicated with each other for each color and the communicating holes 68 formed in the respective plates are communicated with each other for each color, so as to constitute passages through which inks flow. Moreover, the total of 14 ink discharge ports 66 formed in the both end parts in the conveying direction are respectively connected through the communicating members 36 to the total of 14 ink supply ports 49 of the head section 20.

In Modification 1, for such a configuration, the connection passages are not bent up and down, and the connection passages of inks of the respective colors intersect with each other when seen up and down, thereby bent portions of the connection passages are reduced that an ink flow is easy to collect. Here, the shape of the connection passage formed in the each plate is not limited to the above-mentioned configuration. For example, although in the above-mentioned configuration the two supply passages extend from the communicating hole on the left or right side and branch into two passages, respectively, to be connected to the ink discharge ports, for magenta ink, cyan ink and yellow ink, four supply passages may extend from a communicating hole, respectively to be connected to ink discharge ports. Also, although in the above-mentioned configuration the supply passages are constructed to be linear, the configuration of the supply passage is not limited to be linear and may be constructed to contain a curve. Moreover, the order in which the four plates are stacked is not limited to the above-mentioned order. In addition, although in the above-mentioned configuration the film is arranged between the plate and the plate, employable configurations are not limited to this arrangement. Instead of the film, another plate may be arranged between the plate and the plate. Furthermore, the supply ports and the ink discharge ports may not be arranged in left-right symmetry in the order of black, yellow, cyan and magenta. For example, on both of the right and left sides of the supply ports and the ink discharge ports of black ink, the supply ports and the ink discharge ports of the color inks of three colors may be arranged in the same order of magenta→cyan→yellow from left to right, and the order of colors may be any order.

In the printer 1, when a negative pressure in a passage due to a water head difference between a meniscus formed in an opening of the nozzle 47 and a liquid surface of ink stored in the ink chamber 61 falls below a meniscus withstanding pressure not for breaking a meniscus formed in the nozzle 47, the meniscus is broken, air intrudes into the passage, and then a state of inability to eject may be caused. Specifically, immediately after ejection of ink, a pressure in a passage becomes suddenly large toward a side of the negative pressure. Therefore, the damper film 34 is provided as a wall of the ink chamber so that the negative pressure in the passage does not fall below the meniscus withstanding pressure, thereby a negative pressure fluctuation is absorbed by a deformation of the damper film 34.

In Modification 1, the supply ports 49 are provided in the both end parts in the conveying direction, therefore, a distance between the supply port 49 and the nozzle 47 furthermost from the supply port 49 is small, as compared with the configuration where the supply ports 49 are provided in only one end part in the conveying direction. In a case where the distance is small, the passage resistance between the ink chamber 61 and the nozzle 47 is small, and a pressure loss of the passage is also small. Accordingly, since the pressure loss is small in Modification 1 as compared with the configuration where the supply ports are provided in only one end part, a negative pressure in a passage immediately after ejection of ink is small.

Consequently, since a negative pressure in a passage immediately after ejection of ink is small in Modification 1, the negative pressure in the passage does not fall below the meniscus withstanding pressure even when a negative pressure to be absorbed by the damper film 34 is small. Since a performance of the damper film 34 is proportional to an area of the damper film 34, a size of the damper film 34 can be reduced.

(Modification 2)

Although in the above-mentioned embodiment, the supply ports 49 of the passage unit 40 and the ink discharge ports 66 of the distribution member 32 are arranged in the end part thereof in the upstream (backward side) of the conveying direction, in Modification 2 the supply ports 49 and the ink discharge ports 66 are arranged in a region other than the both end parts thereof in the conveying direction.

Figure 10:
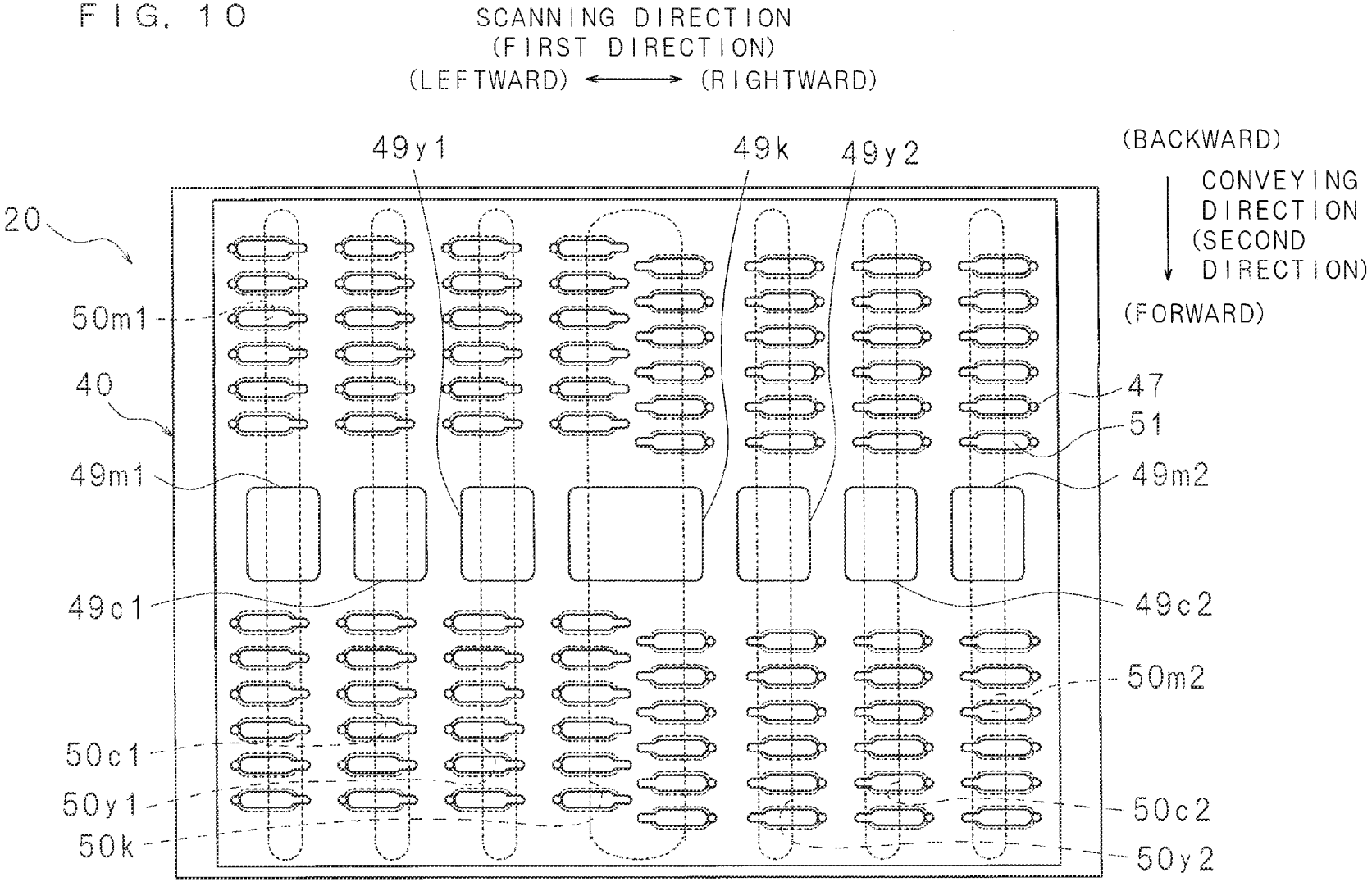
FIG. 10 is a top view of a head section according to Modification 2.
Figure 11:
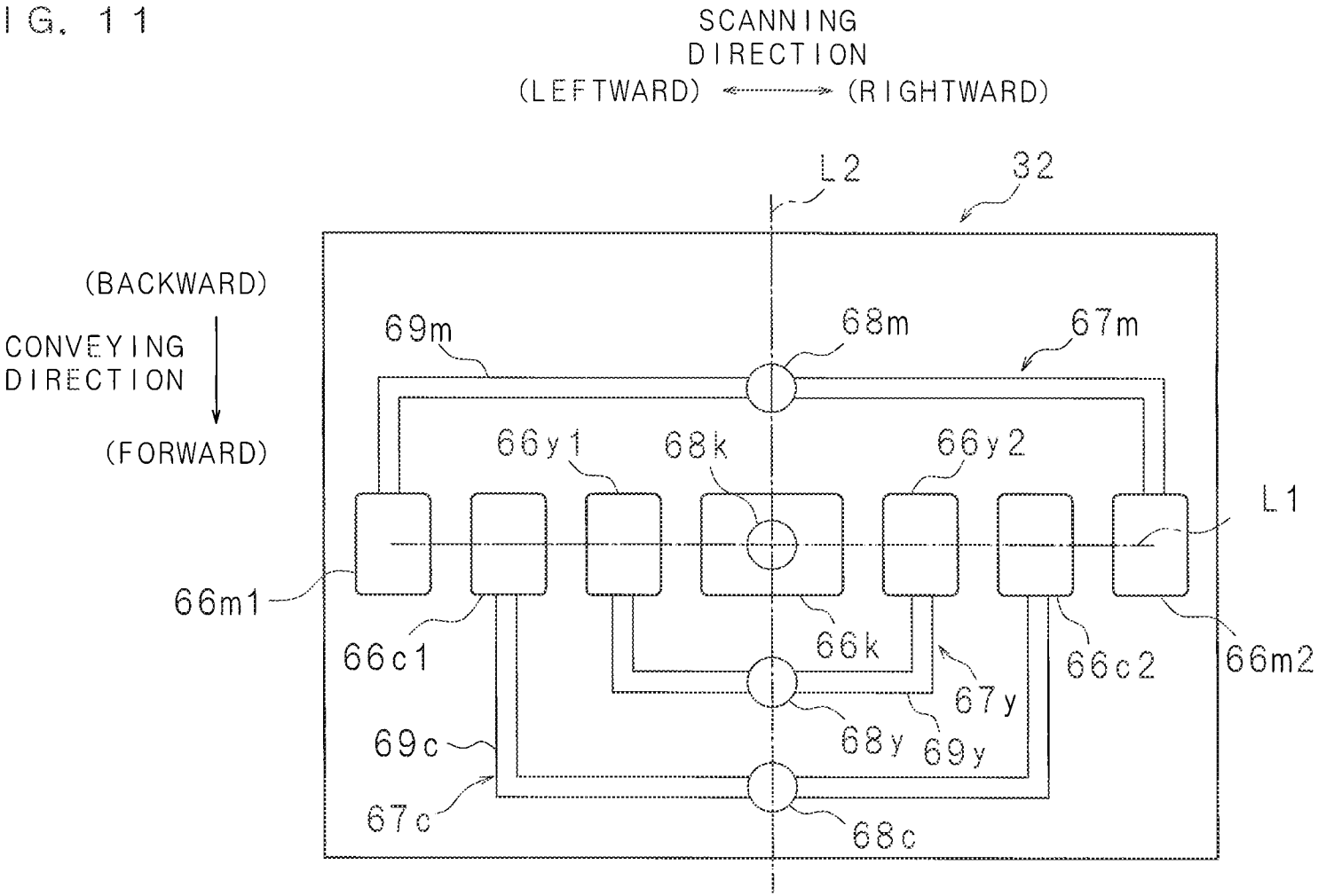
FIG. 11 is horizontal sectional views of a distribution member according to Modification 2.

FIG. 10 is a top view of a head section according to Modification 2, and FIG. 11 is horizontal sectional views of a distribution member 32 according to Modification 2.

As illustrated in FIG. 10, seven supply ports 49 through which magenta ink, cyan ink, yellow ink and black ink flow are aligned in the scanning direction in a region of a middle part other than the both end parts of the passage unit 40 in the conveying direction. The seven supply ports 49 consist of a supply port 49*k* of black ink, two supply ports 49*y*1 and 49*y*2 of yellow ink, two supply ports 49*c*1 and 49*c*2 of cyan ink, and two supply ports 49*m*1 and 49*m*2 of magenta ink. The supply ports are arranged in left-right symmetry in the order of the supply port 49*y*1 and 49*y*2 of yellow ink, the supply port 49*c*1 and 49*c*2 of cyan ink, and the supply port 49*m*1 and 49*m*2 of magenta ink while the supply port 49*k* of black ink is centrally arranged. In such a configuration, the supply ports 49 arranged in a region of the middle part other than the both end parts of the passage unit 40 in the conveying direction are formed in a region of a middle part other than the both end parts of the manifolds 50. Here, although the supply ports are arranged in left-right symmetry in the order of the supply port 49*k* of black ink, the supply ports 49*y*1 and 49*y*2 of yellow ink, the supply ports 49*c*1 and 49*c*2 of cyan ink, and the supply ports 49*m*1 and 49*m*2 of magenta ink, they may not be arranged in this order, and the order of colors may be any order.

As illustrated in FIG. 11, seven ink discharge ports 66 are formed in the region of the middle part other than the both end parts of the distribution member 32 in the conveying direction, are aligned in the scanning direction, and are arranged at positions located immediately above the seven supply ports 49 of the supply unit 40. The seven ink discharge ports 66 consist of an ink discharge port 66*k* of black ink, two ink discharge ports 66*y*1 and 66*y*2 of yellow ink, two ink discharge ports 66*c*1 and 66*c*2 of cyan ink, and two ink discharge ports 66*m*1 and 66*m*2 of magenta ink. The ink discharge ports are arranged in left-right symmetry in the order of yellow, cyan and magenta while the ink discharge port of black ink is centrally arranged. Also, the seven ink discharge ports 66 are respectively connected through the communicating members 36 to the seven ink supply ports 49 of the head section 20. Here, although the ink discharge ports are arranged in left-right symmetry in the order of black, yellow, cyan and magenta, they may not be arranged in this order, and the order of colors may be any order.

Moreover, the distribution member 32 is provided with four connection passages 67 respectively for supplying inks of four colors sent through the ejection holes 62 from the four ink chambers 61 of the sub tank 31, to the seven supply ports 49 of the head section 20. Each of the three connection passages 67 of magenta ink, cyan ink and yellow ink includes a communicating hole 68 in communication with the ejection hole 62 of the sub tank 31 and a supply passage 69 connecting the communicating hole 68 to the ink discharge ports 66, and is arranged in left-right symmetry with respect to a straight line L2 perpendicular to a line segment L1 joining the two ink discharge ports 66*m*1 and 66*m*2 of magenta ink. On the other hand, in the connection passage 67 of black ink, a communicating hole 68*k* and an ink discharge port 66*k* overlap with each other in the up and down directions, thus the connection passage 67 does not include a supply passage. The four communicating holes 68 are different from those in the above-mentioned embodiment, and are arranged on the straight line L2 in the center portion of the distribution member 32 in the scanning direction in the order of magenta, black, yellow and cyan from the backward to the forward. According to the arrangement of the communicating holes, the four ink chambers 61 and the four ejection holes 62 of the sub tank 31 are arranged in the forward and backward directions in correspondence to the arrangement of the communicating holes 68.

In Modification 2, the supply passage 69*m* of magenta ink of the distribution member 32 extends from the communicating hole 68*m* on the left or right side, is bent in the middle so as to extend forward and then is connected to the ink discharge ports 66*m*1 and 66*m*2. The supply passage 69*c* of cyan ink and the supply passage 69*y* of yellow ink respectively extend from the communicating hole 68*c* and the communicating hole 68*y* on the left or right side, are bent in the middle so as to extend backward and then are connected to the ink discharge ports 66*c*1 and 66*c*2 and the ink discharge ports 66*y*1 and 66*y*2.

Figure 12:
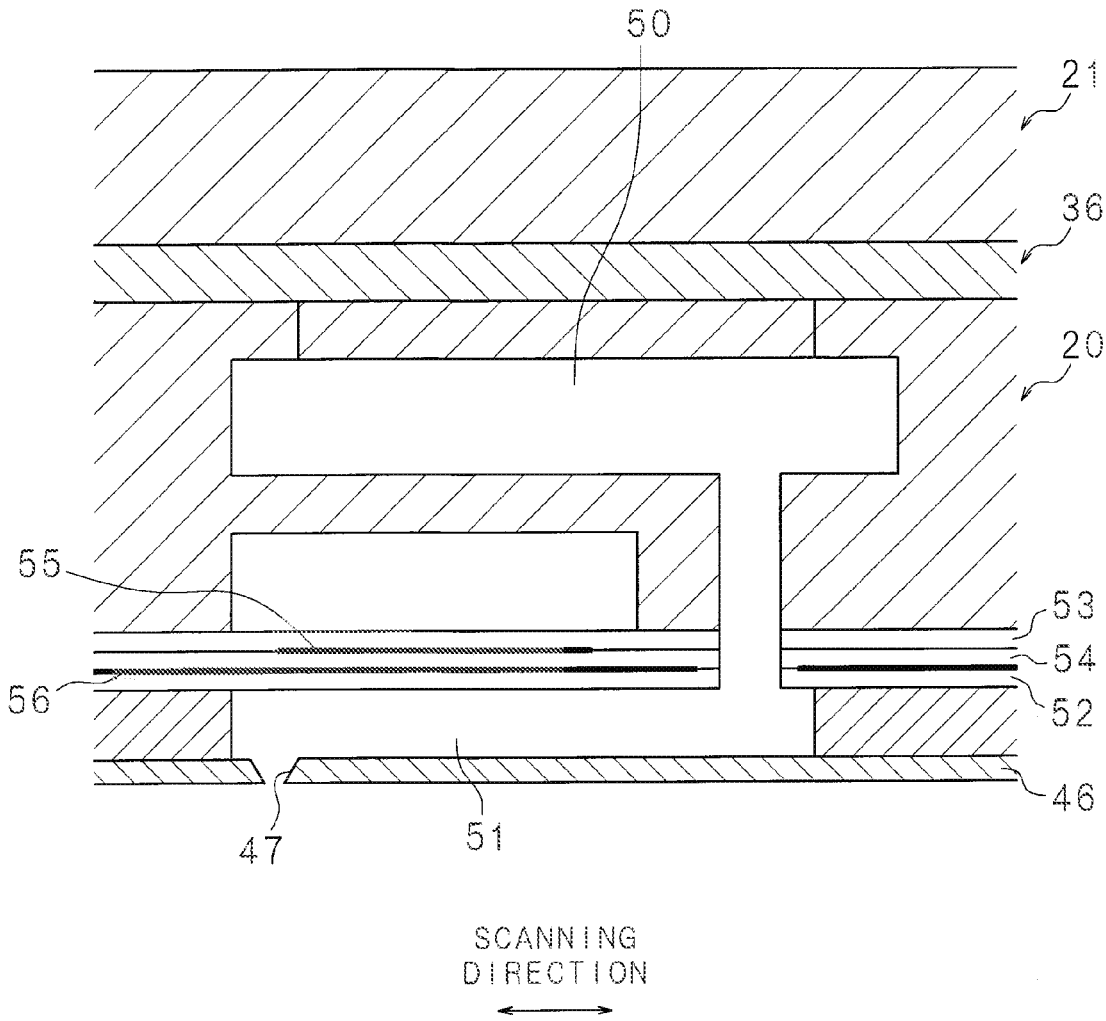
FIG. 12 is an enlarged sectional view showing a position of a manifold of the head section according to Modification 2.

In the above-mentioned embodiment, the pressure chambers 51 and the piezoelectric actuator 41 are arranged above the manifold 50, and in a case where the configuration in which "the supply ports are arranged in the region other than the both end parts in the conveying direction" is applied to such a configuration, the pressure chambers 51 and the piezoelectric actuator 41 are required to be arranged around the supply ports. However, in a case where as illustrated in FIG. 12, the manifold 50 is arranged between the ink supply section 21 and the individual passage containing the pressure chamber 51 and the nozzle 47 in the up and down directions, the above-mentioned problem does not occur.

Here, in Modification 2, the manifold 50 is arranged between the ink supply section 21 and the individual passage containing the pressure chamber 51 and the nozzle 47, but the arrangement of the manifold is not limited to this. For example, the manifold may be aligned with the pressure chamber and the nozzle on the left or right side.

According to Modification 2, a distance between the supply port and the nozzle furthermost from the supply port is small, as compared with the configuration where the supply ports are provided in only one end part. Thus, Modification 2 brings about the similar effect as that in Modification 1. Furthermore, in Modification 2, the configuration of the connection passage is simpler than that in Modification 1 to further prevent the pressure loss.

1] In the above-mentioned embodiment, the lengths of the four ink chambers 61 in the scanning direction are different from each other and hence the areas of the four ink chambers 61 are also different from each other. Thus, it is preferable that the ink chamber 61 located on the most backward side (the side opposite to the ink supply side) and having the greatest length in the scanning direction (also the greatest area) contains an ink whose collected air increases most rapidly.

For example, an ink having the highest ink consumption rate in the head section 20 may be supplied to the ink chamber 61 located on the most backward side. For example, black ink used in both of text printing and color printing and hence tending to have the highest ink consumption rate may be supplied to the ink chamber 61 located on the most backward side. Further, in the head section 20, in a case that the number of nozzles 47 ejecting a given ink (e.g., black ink) is greater than the number of nozzles 47 ejecting the inks of other kinds, the consumption rate of the given ink tends to be high. Thus, in this case, the given ink is supplied to the ink chamber 61 located on the most backward side.

Further, in some cases, the easiness of air mixing is different among the inks of four colors because of a difference in the thickness, the material, or the like among the four tubes 22 respectively supplying the inks of four colors. In this case, an ink having the highest air mixing easiness may be supplied to the ink chamber 61 located on the most backward side and an ink having the lowest air mixing easiness may be supplied to the ink chamber 61 located on the most forward side.

Figure 13:
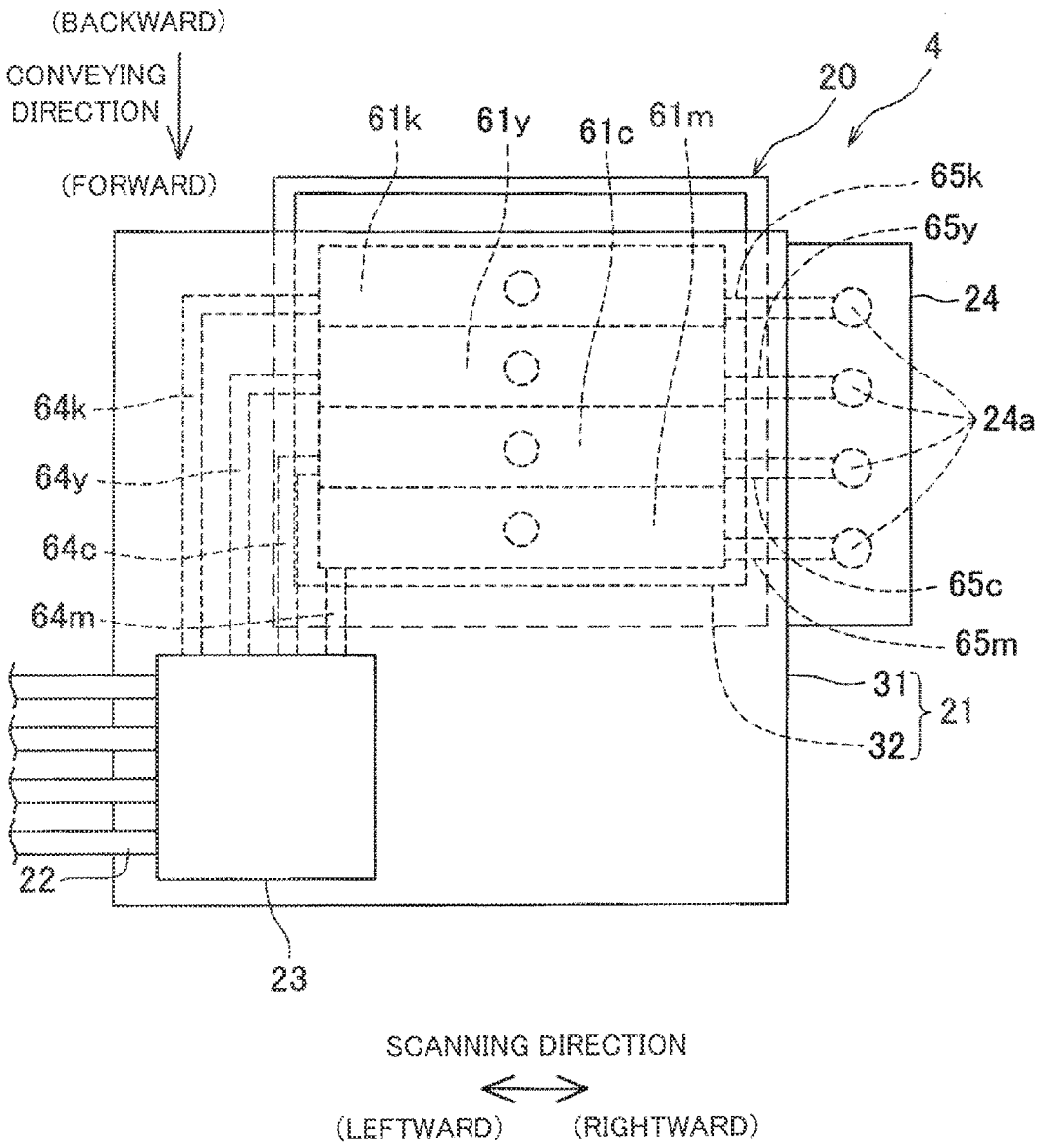
FIG. 13 is a top view of an ink ejection device according to a modification.

2] As illustrated in FIG. 13, the lengths of the four ink chambers 61 in the scanning direction may be equal to each other. In this case, the areas of all four ink chambers 61 are allowed to be increased. Nevertheless, as illustrated in FIG. 13, in a case that the ink is to be supplied to the sub tank 31 from the forward side, the ink introduction passage 64 supplying the ink to the ink chamber 61 located on the backward side need be arranged on the left side such as to bypass the ink chambers 61 on the forward side. This causes a disadvantage of size increase in the sub tank 31 in the scanning direction.

Figure 14:
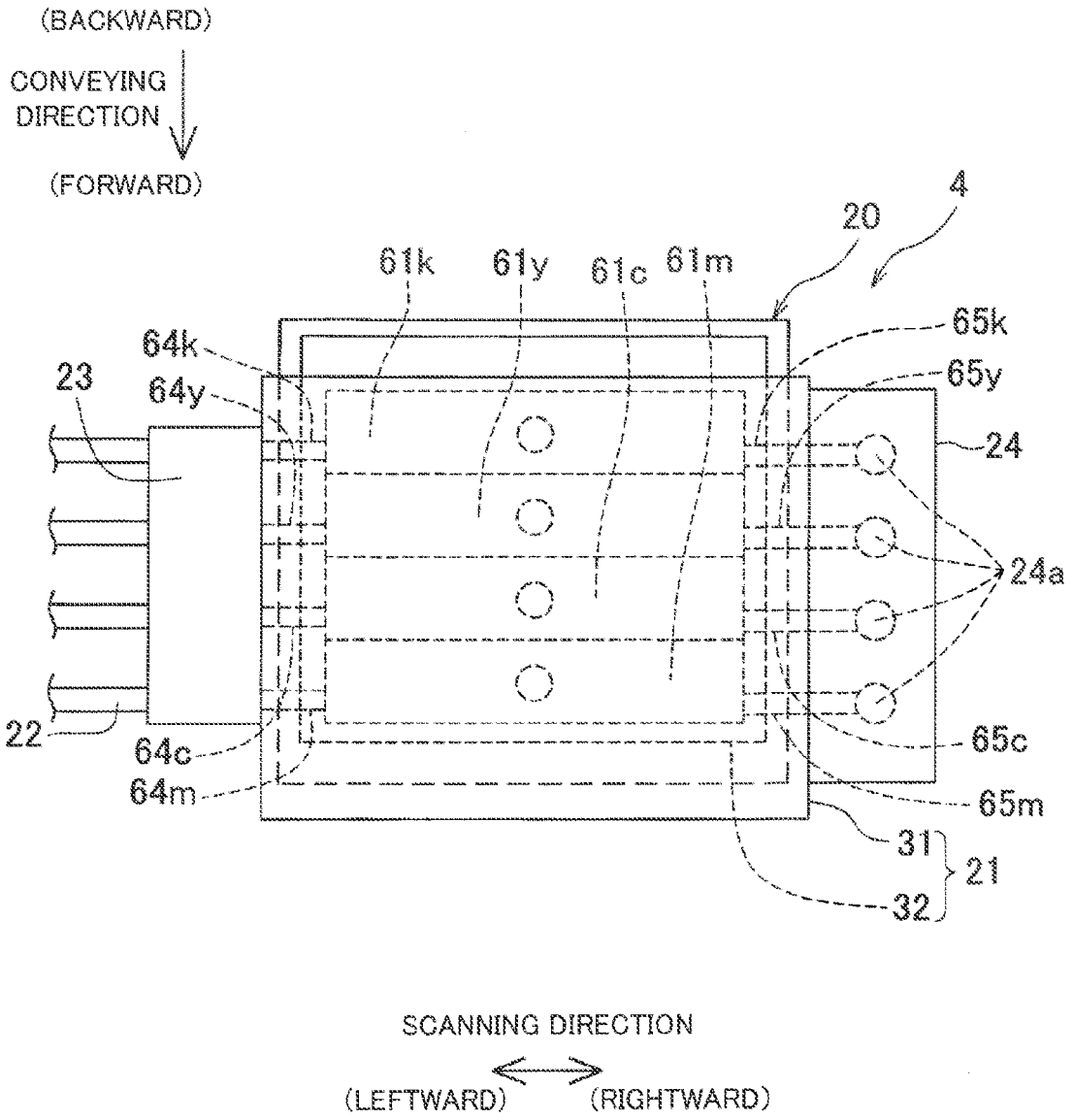
FIG. 14 is a top view of an ink ejection device according to another modification.

Here, as illustrated in FIG. 14, a tube joint 23 may be provided on the left side-surface of the portion of the sub tank 31 where the four ink chambers 61 are formed. In this case, the four ink introduction passages 64 are formed such as to extend in the scanning direction in order that the tube joint 23 on the left side should be linearly joined respectively to the four ink chambers 61 on the right side. In FIG. 14, in contrast to FIG. 13, the necessity is avoided that the size of the sub tank 31 should be increased in the scanning direction in order to ensure an arrangement region for the four ink introduction passages 64. Further, the necessity is avoided that a region necessary for arrangement of the tube joint 23 should be ensured in the forward end part of the sub tank 31. This permits size reduction of the sub tank 31 also in the conveying direction.

3] In the above-mentioned embodiment, the connection passages 67 in the distribution member 32 have a passage structure of left-right symmetry (line symmetry). However, such a line symmetric structure is not indispensable. For example, even when two right and left supply passages (branched passages) through which an ink of the same color flows have mutually different lengths, the difference in the passage resistance of the two supply passages is allowed to be reduced by employing mutually different passage widths.

Further, employable configurations are not limited to that one connection passage 67 connected to the ink chamber 61 is branched in the middle. That is, a configuration may be employed that two connection passages 67 are respectively connected to one ink chamber 61 and then the ink is independently supplied through the two connection passages 67 to the two supply ports 49.

Figure 15:
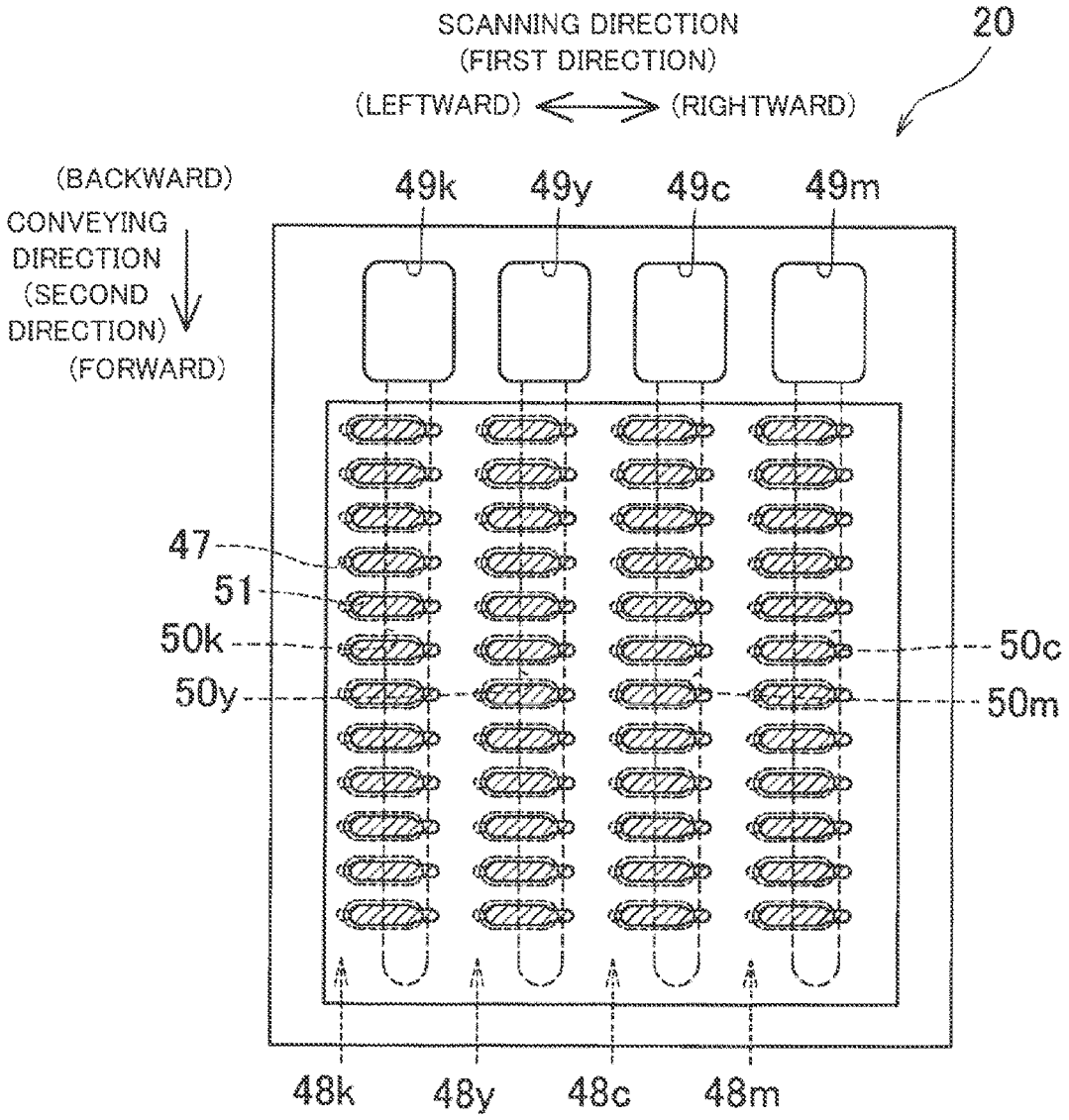
FIG. 15 is a top view of a head section according to another modification.

4] In the above-mentioned embodiment, in the head section 20, two supply ports 49 are provided for each of the color inks of three colors consisting of yellow, cyan, and magenta and then the supply ports 49 of these color inks are arranged separately onto each of the right and left sides of the supply port 49*k* of black ink. In contrast, as illustrated in FIG. 15, the head section 20 may have a configuration that one supply port 49 alone is provided for each ink of any color. Here, in this case, in contrast to the above-mentioned embodiment, in the distribution member 32 between the sub tank 31 and the head section 20, the connection passage 67 connected to one ink chamber 61 need not be divided into two in order to supply the ink respectively to the two supply ports 49.

5] In the above-mentioned embodiment, the flexible damper film 34 is provided as the upper wall of the sub tank 31 (a part of the wall) forming the ink chambers 61 and then the ink chambers 61 serve as damper chambers. However, this configuration is not indispensable. That is, damper chambers provided with the damper film 34 may be provided separately from the ink chambers 61. Further, in a case that the pressure fluctuation generated in the passages in the sub tank 31 is relatively small, the damper film 34 may be omitted.

As described above, the above-mentioned embodiment and the modifications thereof are applied to an ink ejection device of an ink jet printer ejecting ink onto recording paper so as to print an image or the like. In addition, the embodiment and the modifications may be applied also to a liquid ejection device used in various applications other than printing of an image or the like. For example, the embodiment and the modifications may be applied also to a liquid ejection device ejecting an electrically conductive liquid onto a substrate so as to form an electrically conductive pattern on a surface of the substrate.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A liquid ejection device comprising:

a liquid supply section including a plurality of liquid chambers respectively configured to contain plural kinds of liquids; and a liquid ejection section including plural nozzle groups of one or plural nozzle(s) and configured to eject the plural kinds of liquids to be supplied from the liquid supply section;

wherein the liquid ejection section includes a plurality of supply ports which are aligned in a first direction and through which the plural kinds of liquids are supplied;

wherein the liquid supply section includes:

a plurality of connection passages respectively connecting the plurality of supply ports of the liquid ejection section to the liquid chambers configured to contain the liquids to be supplied respectively to the supply ports; and a plurality of air discharge passages connected respectively to the plurality of liquid chambers;

wherein the plurality of liquid chambers are aligned in a second direction intersecting with the first direction;

wherein the liquid ejection section further includes:

a plurality of common passages respectively through which the liquids are supplied from the plurality of supply ports; and a plurality of individual passages respectively which branch from the common passages and extend to the nozzles; and wherein the plurality of supply ports are formed in the plurality of common passages, respectively.

2. The liquid ejection device according to claim 1;

wherein the supply ports include one or plural first supply port(s) through which a first liquid among the plural kinds of liquids is supplied and plural second supply ports through which a second liquid among the plural kinds of liquids is supplied;

wherein the liquid chambers include a first liquid chamber configured to contain the first liquid and a second liquid chamber configured to contain the second liquid; and the connection passages include a first connection passage connecting the first liquid chamber to the one or plural first supply port(s) and a second connection passage connecting the plural second supply ports to the second liquid chamber.

3. The liquid ejection device according to claim 2;

wherein the supply ports include one first supply port and two second supply ports; and wherein the two second supply ports are arranged on both sides of the one first supply port.

4. The liquid ejection device according to claim 3;

wherein the second connection passage includes a communicating part communicating with the second liquid chamber and two branched passages connecting the communicating part to the two second supply ports;

wherein the communicating part is arranged on a straight line that is perpendicular to a line segment joining the two second supply ports and that passes through a middle point of the line segment; and wherein the two branched passages are in line symmetry with respect to the straight line.

5. The liquid ejection device according to claim 1;

wherein the plurality of supply ports are arranged in one end part of the liquid ejection section in the second direction.

6. The liquid ejection device according to claim 5;

wherein the plurality of supply ports are formed in end parts of the plurality of common passages, respectively.

7. The liquid ejection device according to claim 1;

wherein the plurality of supply ports are arranged in a region other than both end parts of the liquid ejection section in the second direction.

8. The liquid ejection device according to claim 7;

wherein the plurality of supply ports are formed in the plurality of common passages, respectively, and a distance between each supply port and one end of each common passage is equal to a distance between each supply port and the other end of each common passage.

9. The liquid ejection device according to claim 7;

wherein the liquid ejection section is arranged on one side of the liquid supply section in a third direction intersecting with the first direction and the second direction; and wherein the plurality of common passages are arranged between the liquid supply section and the individual passages in the third direction.

10. The liquid ejection device according to claim 2;

wherein the supply ports include two pairs of one first supply port and two second supply ports; and wherein the two second supply ports are arranged on both sides of the one first supply port for each pair.

11. The liquid ejection device according to claim 10;

wherein the second connection passage includes a communicating part communicating with the second liquid chamber and four branched passages connecting the communicating part to the four second supply ports;

wherein the communicating part is arranged on a straight line joining the two first supply ports; and wherein the four branched passages are in line symmetry with respect to the straight line.

12. The liquid ejection device according to claim 11;

wherein the first connection passage and the second connection passage are arranged at positions different from each other in a third direction intersecting with the first direction and the second direction.

13. The liquid ejection device according to claim 10;

wherein the two pairs of first and second supply ports are arranged in both end parts of the liquid ejection section in the second direction.

14. The liquid ejection device according to claim 10;

wherein the supply ports are formed in end parts of the plurality of common passages.

15. The liquid ejection device according to claim 14;

wherein the supply ports are formed in both end parts of the plurality of common passages.

16. The liquid ejection device according to claim 1;

wherein a damper film having flexibility is provided as a part of a wall forming the liquid chambers.

17. The liquid ejection device according to claim 1;

wherein the liquid supply section includes a plurality of liquid introduction sections respectively connecting the plurality of liquid chambers to a plurality of liquid storage sections respectively configured to store the plural kinds of liquids, the liquid introduction sections being arranged on one side of the liquid chambers in the first direction.

18. The liquid ejection device according to claim 17;

wherein the plurality of liquid chambers are connected to the plurality of air discharge passages on the other side of the liquid chambers in the first direction.

19. The liquid ejection device according to claim 17;

wherein lengths of the plurality of liquid chambers in the first direction are equal to each other.

20. The liquid ejection device according to claim 1;

wherein the liquid supply section includes a plurality of liquid introduction sections respectively connecting the plurality of liquid chambers to a plurality of liquid storage sections respectively configured to store the plural kinds of liquids, the liquid introduction sections being arranged on one side of the liquid chambers in the second direction; and wherein lengths of the plurality of liquid chambers in the first direction are shorter in an order of arrangement of the liquid chambers toward the one side in the second direction.

21. The liquid ejection device according to claim 20;

wherein the number of nozzles of one nozzle group among the plural nozzle groups of nozzle(s) is larger than the number of nozzle(s) of the other nozzle group; and wherein a liquid to be contained in the liquid chamber having the greatest length in the first direction is a liquid to be ejected through the nozzles of the one nozzle group.

22. The liquid ejection device according to claim 1, further comprising:

an air discharge section connected to the air discharge passages and configured to discharge air in the liquid chambers.

23. The liquid ejection device according to claim 2;

wherein the plural nozzle groups include a first nozzle group through which the first liquid is supplied and plural second nozzle groups through which the second liquid is supplied; and wherein the plural second nozzle groups are arranged on both sides of the first nozzle group.

24. The liquid ejection device according to claim 1;

wherein the plurality of individual passages include a plurality of pressure chambers respectively corresponding to the plurality of nozzles.

* * * * *